US010349508B2

(12) United States Patent
Shiraishi et al.

(10) Patent No.: US 10,349,508 B2
(45) Date of Patent: Jul. 9, 2019

(54) TARGET STORAGE DEVICE

(71) Applicant: Gigaphoton Inc., Tochigi (JP)

(72) Inventors: Yutaka Shiraishi, Oyama (JP); Toshihiro Nishisaka, Oyama (JP); Toshiyuki Hirashita, Oyama (JP); Takuya Ishii, Oyama (JP)

(73) Assignee: Gigaphoton Inc., Tochigi (JP)

( * ) Notice: Subject to any disclaimer, the term of this patent is extended or adjusted under 35 U.S.C. 154(b) by 0 days.

(21) Appl. No.: 15/888,111

(22) Filed: Feb. 5, 2018

(65) Prior Publication Data

US 2018/0160518 A1 Jun. 7, 2018

Related U.S. Application Data

(63) Continuation of application No. PCT/JP2015/075630, filed on Sep. 9, 2015.

(51) Int. Cl.
*H05G 2/00* (2006.01)

(52) U.S. Cl.
CPC ..... *H05G 2/005* (2013.01); *H05G 2/006* (2013.01); *H05G 2/008* (2013.01)

(58) Field of Classification Search
USPC ..... 250/504 R
See application file for complete search history.

(56) References Cited

U.S. PATENT DOCUMENTS 4,135,093 A 1/1979 Kim
8,742,378 B2 * 6/2014 Kameda ..... G03F 7/70025 250/504 R
2009/0224181 A1 9/2009 Abe et al.
2010/0258748 A1 * 10/2010 Vaschenko ..... H05G 2/003 250/504 R
2013/0134326 A1 * 5/2013 Yabu ..... H05G 2/003 250/455.11
2013/0247620 A1 9/2013 Ookubo
2014/0000307 A1 1/2014 Fuhr et al.
2014/0047841 A1 2/2014 Yim
2016/0255709 A1 9/2016 Iwamoto et al.

FOREIGN PATENT DOCUMENTS

JP S64-059099 A 3/1989
JP 2000-215998 A 8/2000
JP 2002-348658 A 12/2002
JP 2008-294393 A 12/2008
JP 2009-218323 A 9/2009
JP 2012-199005 A 10/2012
(Continued)

OTHER PUBLICATIONS

International Search Report issued in International Application No. PCT/JP2015/075630; dated Dec. 15, 2015.
(Continued)

*Primary Examiner* — Phillip A Johnston
(74) *Attorney, Agent, or Firm* — Studebaker & Brackett PC

(57) ABSTRACT

A target storage device may include a tank configured to store a target that generates extreme ultraviolet light when being irradiated with laser light, a heater connected with the tank and configured to heat the tank, and a radiation member disposed to cover at least a part of the tank connected with the heater and configured to reflect heat radiation from the tank and the heater toward the tank.

20 Claims, 10 Drawing Sheets

(56) References Cited

FOREIGN PATENT DOCUMENTS

| | | | |
|---|---|---|---|
| JP | 2014-504714 | A | 2/2014 |
| JP | 2014-504716 | A | 2/2014 |
| WO | 2012/073876 | A1 | 6/2012 |
| WO | 2015/097888 | A1 | 7/2015 |

OTHER PUBLICATIONS

International Preliminary Report on Patentability issued in International Application No. PCT/JP2015/075630; dated Mar. 22, 2018.
An Office Action; "Notification of Reasons for Refusal," issued by the Japanese Patent Office dated May 14, 2019, which corresponds to Japanese Patent Application No. 2017-538779 and is related to U.S. Appl. No. 15/888,111; with English Translation.

* cited by examiner

RELATED ART

RELATED ART

TARGET STORAGE DEVICE

CROSS-REFERENCE TO RELATED APPLICATIONS

The present application is a continuation application of International Application No. PCT/JP2015/075630 filed on Sep. 9, 2015. The content of the application is incorporated herein by reference in its entirety.

BACKGROUND

1. Technical Field

The present disclosure relates to a target storage device.

2. Related Art

In recent years, along with miniaturization of a semiconductor process, miniaturization of a transfer pattern in photolithography of a semiconductor process has been developed rapidly. In the next generation, fine processing of 20 nm or less will be demanded. As such, it is expected to develop an exposure device in which a device for generating extreme ultraviolet (EUV) light having a wavelength of about 13 nm and a catoptric system are combined.

As EUV light generation devices, three types of devices are proposed, namely an LPP (Laser Produced Plasma) type device using plasma generated by radiating laser light to a target, a DPP (Discharge Produced Plasma) type device using plasma generated by electric discharge, and an SR (Synchrotron Radiation) type device using orbital radiation light.

CITATION LIST

Patent Literature

Patent Literature 1: Japanese Patent Application Laid-Open No. 2009-218323

Patent Literature 2: International Publication No. WO 2012/073876

Patent Literature 3: National Publication of International Patent Application No. 2014-504714

SUMMARY

A target storage device, according to an aspect of the present disclosure, may include a tank, a heater, and a radiation member. The tank may be configured to store a target that generates extreme ultraviolet light when being irradiated with laser light. The heater may be connected with the tank, and may be configured to heat the tank. The radiation member may be disposed to cover at least a part of the tank connected with the heater, and may be configured to reflect heat radiation from the tank and the heater toward the tank.

BRIEF DESCRIPTION OF THE DRAWINGS

Some embodiments of the present disclosure will be described below as mere examples with reference to the accompanying drawings.

EMBODIMENTS

Contents

Figure 1:
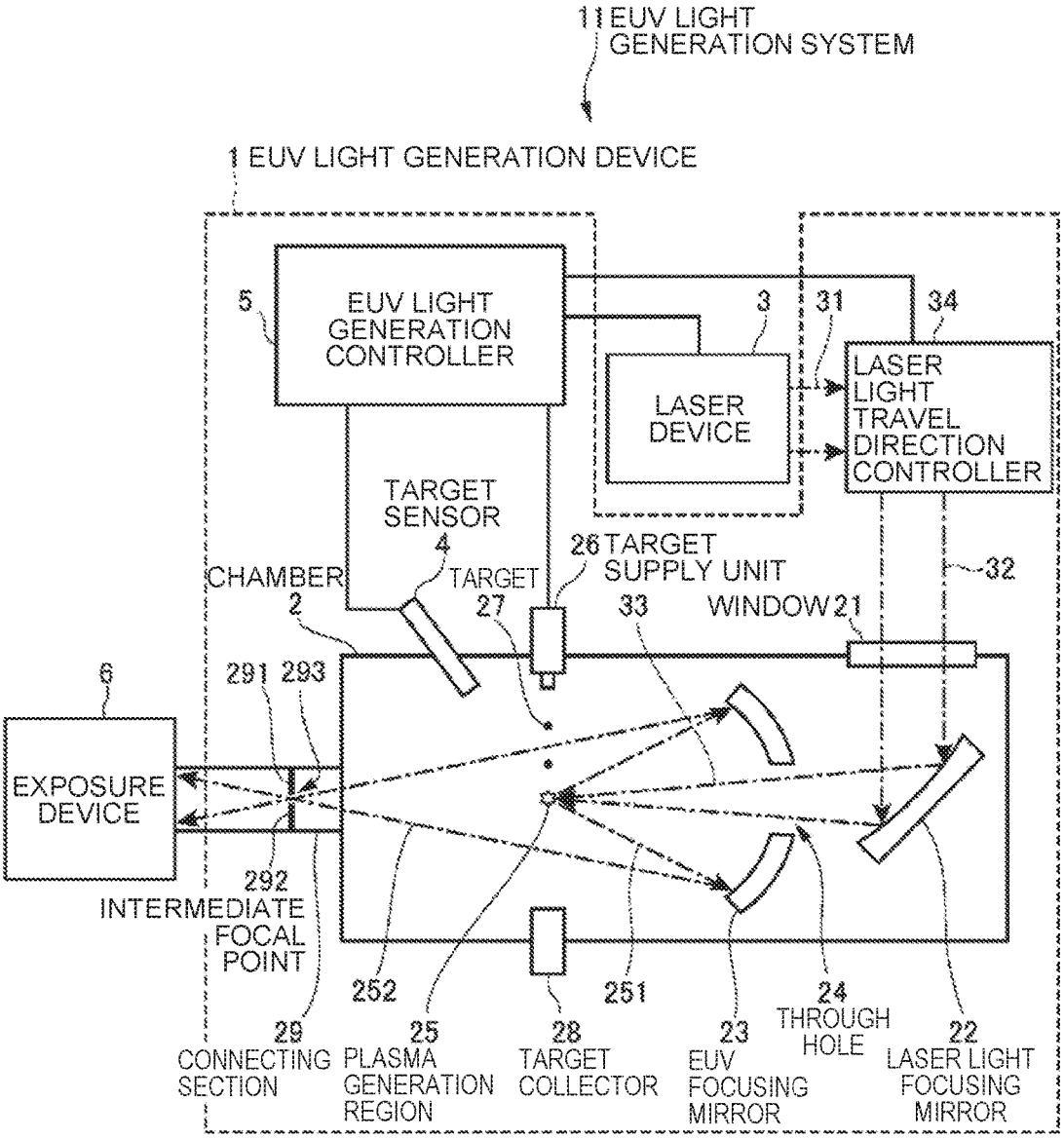
FIG. 1 schematically illustrates a configuration of an exemplary LPP type EUV light generation system.

1. Overall description of EUV light generation system
1.1 Configuration
1.2 Operation
2. Terms
3. Problem
3.1 Configuration of comparative example
3.2 Operation of comparative example
3.3 Problem
4. First embodiment
4.1 Configuration
4.2 Operation and effect
5. Second embodiment
5.1 Configuration
5.2 Operation and effect
6. Third embodiment
6.1 Configuration
6.2 Operation and effect
7. Fourth embodiment
7.1 Configuration
7.2 Operation and effect
8. Fifth embodiment
8.1 Configuration
8.2 Operation
8.3 Effect
9. Sixth embodiment
9.1 Configuration
9.2 Operation
9.3 Effect
10. Others
10.1 Hardware environment of each control unit
10.2 Other modifications and the like Hereinafter, embodiments of the present disclosure will be described in detail with reference to the drawings. The embodiments described below illustrate some examples of the present disclosure, and do not limit the contents of the present disclosure. All of the configurations and the operations described in the embodiments are not always indispensable as configurations and operations of the present disclosure. It should be noted that the same constituent elements are denoted by the same reference numerals, and overlapping description is omitted.

1. Overall Description of EUV Light Generation System

[1.1 Configuration]

FIG. 1 schematically illustrates a configuration of an exemplary LPP type EUV light generation system.

An EUV light generation device 1 may be used together with at least one laser device 3. In the present application, a system including the EUV light generation device 1 and the laser device 3 is called an EUV light generation system 11. As illustrated in FIG. 1 and described below in detail, the EUV light generation device 1 may include a chamber 2 and a target supply unit 26. The chamber 2 may be sealable. The target supply unit 26 may be provided so as to penetrate a wall of the chamber 2. The material of a target 27 supplied from the target supply unit 26 may include, but not limited to, tin, terbium, gadolinium, lithium, xenon, or a combination of any two or more of them.

A wall of the chamber 2 may be provided with at least one through hole. The through hole may have a window 21. Pulse laser light 32 output from the laser device 3 may penetrate the window 21. Inside the chamber 2, an EUV focusing mirror 23 having a spheroidal reflection surface, for example, may be disposed. The EUV focusing mirror 23 may have first and second focuses. On the surface of the EUV focusing mirror 23, a multilayer reflection film in which molybdenum and silicon are alternately layered, for example, may be formed. It is preferable that the EUV focusing mirror 23 is disposed such that the first focal point locates in the plasma generation region 25 and the second focal point locates at an intermediate focal point (IF) 292, for example. The EUV focusing mirror 23 may have a through hole 24 in a center portion thereof, and pulse laser light 33 may pass through the through hole 24.

The EUV light generation device 1 may include an EUV light generation controller 5, a target sensor 4, and the like. The target sensor 4 may have an image capturing function, and may be configured to detect presence, trajectory, position, velocity, and the like of the target 27.

The EUV light generation device 1 may also include a connecting section 29 configured to communicate the inside of the chamber 2 and the inside of an exposure device 6 with each other. In the connecting section 29, a wall 291 having an aperture 293 may be provided. The wall 291 may be disposed such that the aperture 293 locates at a position of the second focal point of the EUV focusing mirror 23.

Moreover, the EUV light generation device 1 may also include a laser light travel direction controller 34, a laser light focusing mirror 22, a target collector 28 configured to collect the target 27, and the like. The laser light travel direction controller 34 may have an optical element configured to define the travel direction of the laser light, and an actuator configured to regulate the position, posture, and the like of the optical element.

[1.2 Operation]

Referring to FIG. 1, the pulse laser light 31 output from the laser device 3 may pass through the laser light travel direction controller 34 and penetrate the window 21 as pulse laser light 32 to enter the chamber 2. The pulse laser light 32 may travel inside the chamber 2 along at least one laser light path, and may be reflected by the laser light focusing mirror 22 and radiated as the pulse laser light 33 to at least one target 27.

The target supply unit 26 may be configured to output the target 27 toward the plasma generation region 25 in the chamber 2. The target 27 may be irradiated with at least one pulse included in the pulse laser light 33. The target 27 irradiated with the pulse laser light 33 is made into plasma, and from the plasma, EUV light 251 may be radiated along with radiation of light having another wavelength. The EUV light 251 may be reflected selectively by the EUV focusing mirror 23. EUV light 252 reflected by the EUV focusing mirror 23 may be focused at an intermediate focal point 292 and output to an exposure device 6. It should be noted that one target 27 may be irradiated with a plurality of pulses included in the pulse laser light 33.

The EUV light generation controller 5 may be configured to integrate the control of the entire EUV light generation system 11. The EUV light generation controller 5 may be configured to process image data or the like of the target 27 captured by the target sensor 4. Further, the EUV light generation controller 5 may perform at least one of control of timing when the target 27 is output, control of output direction and the like of the target 27, for example. Furthermore, the EUV light generation controller 5 may perform at least one of control of output timing of the laser device 3, control of the travel direction of the pulse laser light 32, and control of the light focusing position of the pulse laser light 33, for example. The various types of control described above are mere examples, and another type of control may be added when necessary.

2. Terms

The term "Target" means an object irradiated with laser light introduced to the chamber. A target irradiated with laser light is made into plasma and radiates EUV light.

The term "Droplet" means a mode of a target to be supplied to the chamber.

The term "Plasma generation region" means a predetermined region in the chamber. A plasma generation region is a region where a target output to the chamber is irradiated with laser light and the target is made into plasma.

The term "Target trajectory" means a channel on which a target output into the chamber travels. In the plasma generation region, a target trajectory may intersect an optical path of the laser light introduced to the chamber.

The term "Target storage device" means a device connected with a chamber and configured to store targets. The target storage device includes at least one of a target supply unit and a target collector. In the case where the target storage device includes a target supply unit, the target storage device is a device configured to store a target to be output into the chamber. In the case where the target storage device includes a target collector, the target storage device is a device configured to store a target not irradiated with laser light among the targets output into the chamber.

The term "Z axis direction" means a direction that the EUV light generation device outputs EUV light. This means that the Z axis direction is a direction that EUV light is output from the chamber of the EUV light generation device to an exposure device.

The term "Y axis direction" means a direction that the target supply unit outputs a target into the chamber.

The term "X axis direction" means a direction orthogonal to the Y axis direction and the Z axis direction.

3. Problem

As an example of a target storage device of a comparative example, a target collector 28 will be described with use of FIGS. 2 and 3.

The target collector 28 may be a device that collects the target 27 output the target supply unit 26 into the chamber 2, as illustrated in FIG. 1.

In particular, the target collector 28 may be a device that collects the target 27 not irradiated with pulse laser light 33, among the targets 27 output from the target supply unit 26 into the chamber 2.

As illustrated in FIG. 1, the target collector 28 may be provided on a lateral face portion of the chamber 2. The target collector 28 may be disposed on the extended line of the target trajectory. The target collector 28 may be disposed inside the chamber 2.

It should be noted that the target 27 may be made with use of a metallic material. The target 27 may be made with use of at least one of tin, terbium, and gadolinium.

Further, the target supply unit 26 may store the target 27 in a molten state. The target supply unit 26 may output the target 27 in a molten state as a droplet toward a plasma generation region 25 in the chamber 2 to thereby supply the target 27 to the plasma generation region 25.

[3.1 Configuration of Comparative Example]

Figure 2:
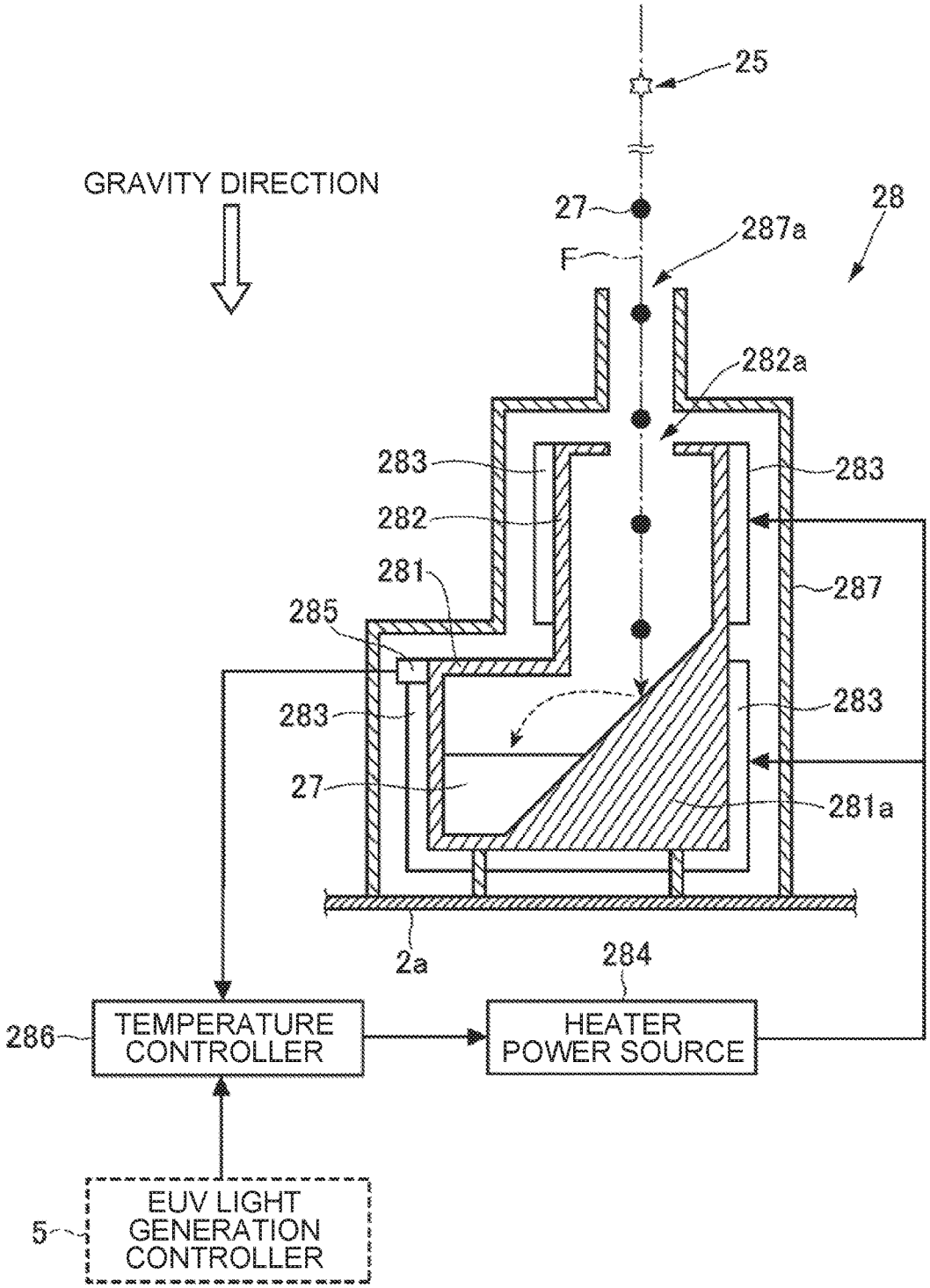
FIG. 2 is a drawing for explaining a target collector that is an example of a target storage device of a comparative example.

FIG. 2 is a drawing for explaining the target collector 28 that is an example of a target storage device of a comparative example.

The target collector 28 may include a tank 281, a collection unit 282, a heater 283, a heater power source 284, a temperature sensor 285, a temperature controller 286, and a casing 287.

The tank 281 may be a container configured to store the target 27 not irradiated with the pulse laser light 33. The tank 281 may store the target 27 therein in a molten state.

The tank 281 may be made with use of a material that resists chemical reaction with the target 27. When the target 27 is tin, a material that resists chemical reaction with the target 27 may be at least one of SiC, $SiO_2$ including quartz, $Al_2O_3$, molybdenum, tungsten, and tantalum.

The tank 281 may be made with use of a material that resists being got wet by the molten target 27. The tank 281 may be made with use of a material, a contact angle of which with the molten target 27 is equal to or larger than 90° but equal to or smaller than 180°.

The tank 281 may be made with use of a material having heat resistance to a temperature equal to or higher than the melting point of the target 27.

When the target 27 is tin, the tank 281 may be made with use of molybdenum or quartz, for example.

The tank 281 may be formed in a hollow cylindrical shape.

The tank 281 may be disposed in the chamber 2. The tank 281 may be connected with a wall 2*a* of the chamber 2.

The tank 281 may have an inclined portion 281*a* therein.

The inclined portion 281*a* may be a member that allows the target 27 not irradiated with the pulse laser light 33 to collide with it and receives the target 27.

The inclined portion 281*a* may be formed as a part of the wall of the tank 281.

The inclined portion 281*a* may be made with use of a material that resists chemical reaction with the target 27.

The inclined portion 281*a* may be made of a material that resists being got wet by the molten target 27. The inclined portion 281*a* may be made with use of a material, the contact angle of which with the molten target 27 is equal to or larger than 90° but equal to or smaller than 180°.

The inclined portion 281*a* may be made of a material having heat resistance to the temperature equal to or higher than the melting point of the target 27.

The inclined portion 281*a* may be made with use of the same material as that of the tank 281.

When the target 27 is tin, the inclined portion 281*a* may be made of molybdenum or stainless, for example.

The inclined portion 281*a* may be formed at a position crossing a target trajectory F.

The surface of the inclined portion 281*a* may be formed to be inclined with respect to the target trajectory F. The surface of the inclined portion 281*a* may be formed such that the inclination angle against the target trajectory F is other than 90°.

The surface of the inclined portion 281*a* may be a surface that receives the target 27 not irradiated with the pulse laser light 33 by allowing the target 27 to collide with it. The surface of the inclined portion 281*a* may be formed to reflect the target 27 toward the internal space of the tank 281.

The collection unit 282 may be a member that collects the target 27 not irradiated with the pulse laser light 33 and guides it to the tank 281.

The collection unit 282 may be made with use of a material that resists chemical reaction with the target 27.

The collection unit 282 may be made of a material that resists being got wet by the molten target 27. The collection unit 282 may be made with use of a material, the contact angle of which with the molten target 27 is equal to or larger than 90° but equal to or smaller than 180°.

The collection unit 282 may be made with use of a material having heat resistance to the temperature equal to or higher than the melting point of the target 27.

When the target 27 is tin, the collection unit 282 may be made with use of molybdenum or quartz, for example.

The collection unit 282 may be made with use of the same material as that of the tank 281.

The collection unit 282 may be formed in a hollow cylindrical shape.

The collection unit 282 may be formed to extend along the target trajectory F. The collection unit 282 may be disposed such that the center axis thereof substantially matches the target trajectory F.

The collection unit 282 may be connected with the tank 281. The collection unit 282 may be connected with an end portion on the plasma generation region 25 side of the tank 281. The collection unit 282 may be formed integrally with the tank 281.

An end portion on the plasma generation region 25 side of the collection unit 282 may have an opening 282*a*.

The opening 282*a* may be an inlet for allowing the target 27, not irradiated with the pulse laser light 33, to enter the collection unit 282. The opening 282*a* may be formed at a position crossing the target trajectory F of the collection unit 282.

The heater 283 may heat the tank 281 and the collection unit 282.

The heater 283 may be connected with each of the tank 281 and the collection unit 282. The heater 283 may be disposed to cover the outer surface of each of the tank 281 and the collection unit 282.

The heater 283 may be connected with the heater power source 284.

The heater power source 284 may be a power source for supplying electric power to the heater 283.

Operation of the heater power source 284 may be controlled by the temperature controller 286.

The temperature sensor 285 may be a sensor that detects the temperature of the tank 281 and the collection unit 282.

The temperature sensor 285 may be provided on at least one outer surface of the tank 281 and the collection unit 282.

The temperature sensor 285 may output temperature detection signals corresponding to the detected temperature of the tank 281 and the collection unit 282, the temperature controller 286.

The temperature controller 286 may be a controller that controls the temperature of the tank 281 and the collection unit 282.

The temperature controller 286 may be connected with the heater power source 284 and the temperature sensor 285.

The temperature controller 286 may be connected with an EUV light generation controller 5.

The casing 287 may accommodate the tank 281 and the collection unit 282 connected with the heater 283.

The casing 287 may be disposed in the chamber 2. The casing 287 may be connected with the wall 2*a* of the chamber 2. The pressure inside the casing 287 may be maintained at almost the same pressure as the pressure in the chamber 2.

An end portion on the plasma generation region 25 side of the casing 287 may have an opening 287*a*. The opening 287*a* may be an inlet for allowing the target 27, not irradiated with the pulse laser light 33, to enter the casing 287. The opening 287*a* may be formed at a position crossing the target trajectory F of the casing 287.

The tank 281, the collection unit 282, the casing 287, and the chamber 2 may be configured such that the insides thereof communicate with each other.

[3.2 Operation of Comparative Example]

Operation of the target collector 28 of the comparative example will be described.

The temperature controller 286 may receive signals designating the target temperature of the tank 281 and the collection unit 282, output from the EUV light generation controller 5.

The temperature controller 286 may receive a temperature detection signal output from the temperature sensor 285.

The temperature controller 286 may control operation of the heater power source 284 that supplies electric power to the heater 283 such that a detected value represented by the temperature detection signal approaches the target temperature.

The target temperature of the tank 281 and the collection unit 282 may be the temperature that is equal to or higher than the melting point of the target 27 and that the target 27 in the tank 281 melts.

When the target 27 is tin, the melting point of the target 27 is 231.5° C. When the target 27 is gadolinium, the melting point of the target 27 is 1,312° C. When the target 27 is terbium, the melting point of the target 27 is 1,356° C.

When the EUV light generation device 1 generates EUV light 252, the target supply unit 26 may output the molten target 27, as a droplet, to the plasma generation region 25 in the chamber 2, with control by the EUV light generation controller 5.

Further, the laser device 3 may output pulse laser light 31 such that the target 27 is irradiated with the pulse laser light 33 in the plasma generation region 25, with control by the EUV light generation controller 5.

The target 27 irradiated with the pulse laser light 33 is made into plasma and may radiate light including the EUV light 251.

On the other hand, the target 27, not irradiated with the pulse laser light 33, may pass through the plasma generation region 25 and travel along the target trajectory F. The target 27 passing through the plasma generation region 25 may enter the casing 287 from the opening 287*a*.

The target 27 entering the casing 287 may enter the collection unit 282 from the opening 282*a*. The target 27 entering the collection unit 282 may pass through the inside of the collection unit 282. The target 27 passing through the collection unit 282 may enter the tank 281 and collide with the surface of the inclined portion 281*a*.

In this way, the collection unit 282 may collect the target 27 by allowing the target 27, not irradiated with the pulse laser light 33, to enter from the opening 282*a*. The collection unit 282 may guide the target 27, not irradiated with the pulse laser light 33, to the tank 281 by allowing the target 27 entering the collection unit 282 to pass therethrough into the tank 281.

The most part of the target 27 colliding with the inclined portion 281*a* may be reflected toward the internal space of the tank 281 and adhere to the inner surface of the wall of the tank 281.

Since the tank 281 is heated to the temperature equal to or higher than the melting point of the target 27, the target 27 adhering to the wall of the tank 281 may flow downward along the wall of the tank 281 in a molten state, and may be stored in the tank 281.

Further, a part of the target 27 colliding with the inclined portion 281*a* may become a splash and spread to the wall of the collection unit 282, and adhere to the inner surface of the wall of the collection unit 282.

Since the collection unit 282 is heated to the temperature equal to or higher than the melting point of the target 27, the target 27 adhering to the wall of the collection unit 282 may flow downward in a molten state along the walls of the collection unit 282 and the tank 281, and may be stored in the tank 281.

[3.3 Problem]

Figure 3:
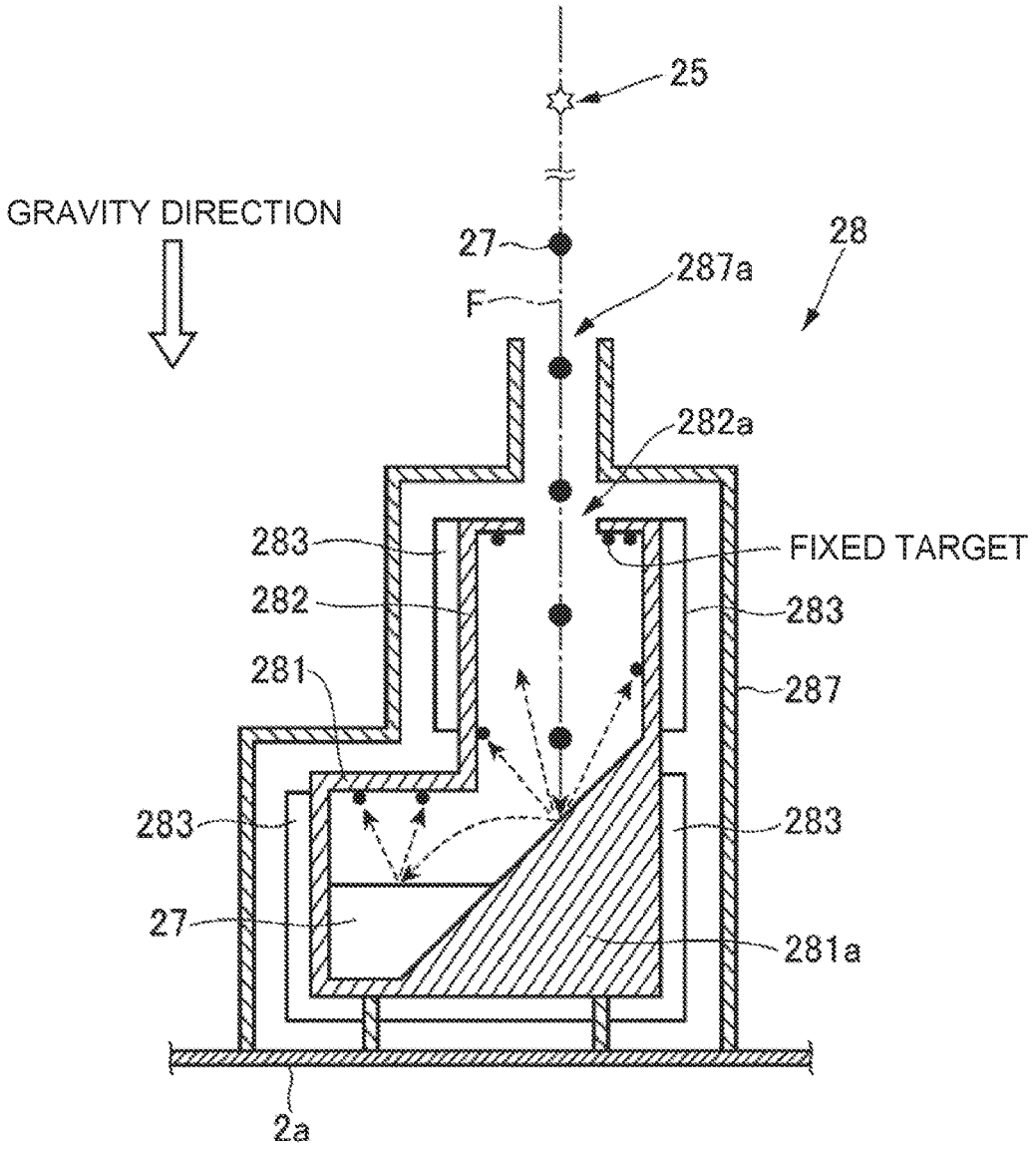
FIG. 3 is a drawing for explaining a problem of a target collector of the comparative example.

FIG. 3 is a drawing for explaining a problem of the target collector 28 of the comparative example.

It may be desired that the target collector 28 has a larger tank 281.

In the case of a larger tank 281, the target collector 28 may store a larger amount of targets 27. As such, the frequency of replacing the tank 281 may be reduced, whereby the operating time of the target collector 28 may become longer.

However, in the case of a larger tank 281, the heat dissipation area of the tank 281 may become longer.

When the heat dissipation area of the tank 281 becomes larger, the target collector 28 may need to increase the output of the heater 283 in order to maintain the temperature of the tank 281 and the collection unit 282 at the temperature equal to or higher than the melting point of the target 27.

Further, when the heat dissipation area of the tank 281 becomes larger, it may be difficult for the target collector 28 to uniformly maintain the temperature of the tank 281 and the collection unit 282.

At that time, the temperature of the tank 281 and the collection unit 282 may become lower locally than the melting point of the target 27, so that it may be difficult to store the target 27 in a molten state. In particular, when the target 27 colliding with the inclined portion 281*a* scatters at a position where the temperature is lower than the melting point of the target 27 in the tank 281 and the collection unit 282, the target 27 may be fixed on the walls of the tank 281 and the collection unit 282. In that case, the following target 27 may further be fixed on the fixed target 27 and deposited. The deposition of the fixed targets 27 may grow and cross the target trajectory F, which may prevent the following target 27 from being collected appropriately.

Accordingly, it may be desired to provide the target collector 28 capable of suppressing fixing of the target 27 on the walls of the tank 281 and the collection unit 282, while suppressing output of the heater 283.

Further, in the case where the target storage device of the comparative example is the target supply unit 26, a problem similar to that of the target collector 28 may be caused in the target supply unit 26.

As described below with use of FIG. 9, the target supply unit 26 may include a tank 261, a nozzle 262, and a heater 263. However, the target supply unit 26 of the comparative example does not have a radiation member 7 illustrated in FIG. 9.

The tank 261 may be a container configured to store the target 27 to be output into the chamber 2 in a molten state.

The nozzle 262 may be a member that is connected with the tank 261 and outputs the target 27 stored in the tank 261 to the chamber 2.

The heater 263 may be a heater configured to heat the tank 261 and the nozzle 262.

Even in the target supply unit 26, a larger tank 261 may be desired to make the operating time longer, similar to the case of the target collector 28.

However, in the case of the larger tank 261, the heat dissipation area of the tank 261 becomes larger, whereby the target supply unit 26 may need to increase the output of the heater 263, similar to the case of the target collector 28.

Further, in the case of the larger tank 261, it may be difficult to uniformly maintain the temperature of the tank 261 and the nozzle 262.

At that time, the temperature of the tank 261 and the nozzle 262 may become lower locally than the melting point of the target 27, whereby the target 27 may be fixed on the walls of the tank 261 and the nozzle 262. In that case, due to the pressure loss caused by the fixed target 27, the molten target 27 may be hardly output appropriately. For example, the molten target 27 may be output at a speed lower than a desired speed, or output on a trajectory deviated from the desired target trajectory F.

Accordingly, it may be desirable to provide the target supply unit 26 capable of suppressing fixing of the target 27 on the walls of the tank 261 and the nozzle 262, while suppressing output of the heater 263.

In view of the above, in the target storage device of the comparative example, there may be room for improving fixing of the target 27 on the wall of the tank while suppressing output of the heater configured to heat the tank configured to store the target 27.

4. First Embodiment

A target storage device of a first embodiment will be described with use of FIG. 4. Specifically, a target collector 28 of the first embodiment will be described as an exemplary target storage device of the first embodiment.

The target collector 28 of the first embodiment may have a configuration in which a radiation member 7 is added to the target collector 28 of the comparative example.

In the configuration of the target collector 28 of the first embodiment, description of the same configuration as that of the target collector 28 of the comparative example is omitted.

[4.1 Configuration]

Figure 4:
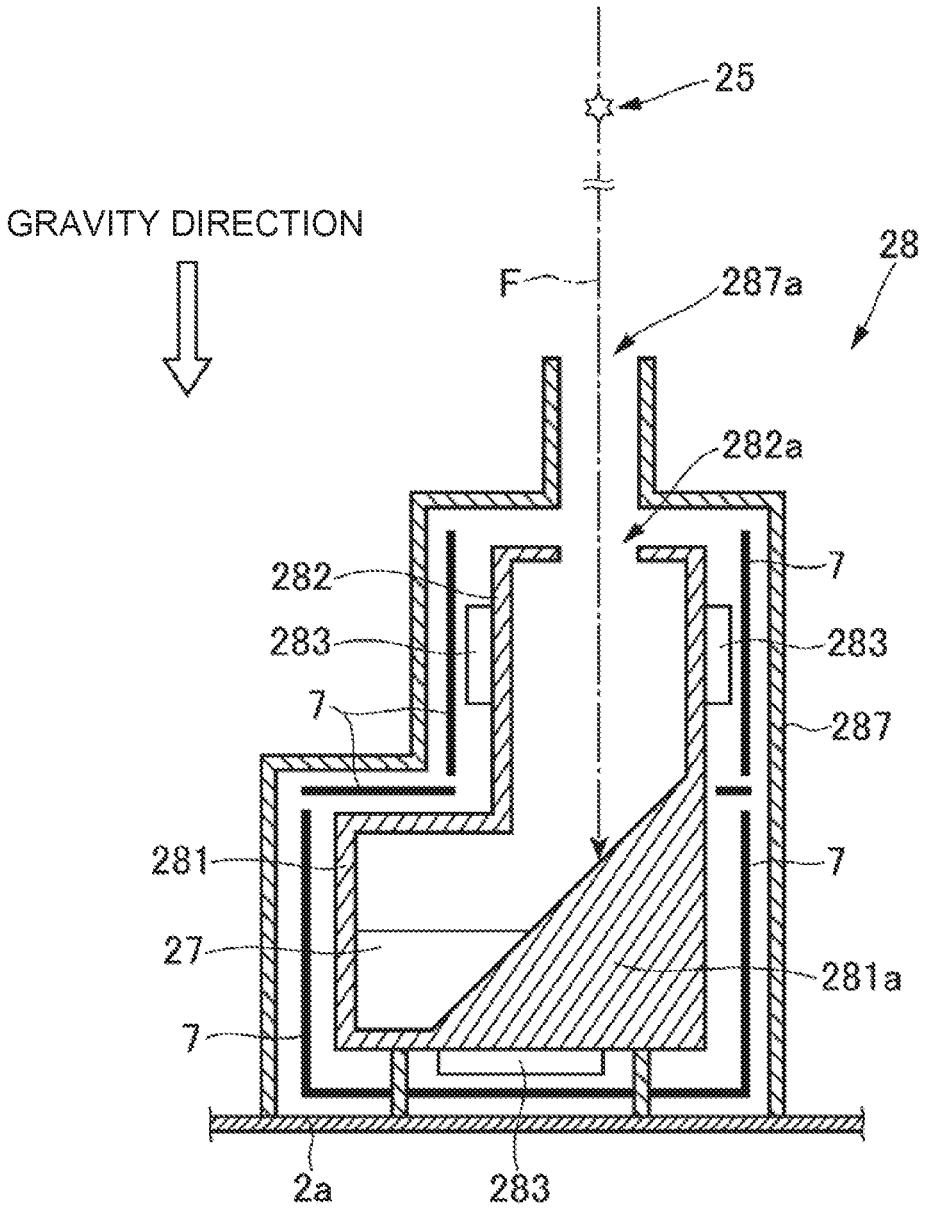
FIG. 4 is a drawing for explaining a target collector that is an example of a target storage device of a first embodiment.

FIG. 4 is a drawing for explaining the target collector 28 that is an exemplary target storage device of the first embodiment. Although the heater power source 284, the temperature sensor 285, the temperature controller 286, and the EUV light generation controller 5 are illustrated in FIG. 3, they are abbreviated in FIG. 4. They are also abbreviated in the following FIGS. 5 to 7.

The target collector 28 of the first embodiment may include the tank 281, the collection unit 282, the heater 283, the heater power source 284, the temperature sensor 285, the temperature controller 286, and the casing 287, similar to the target collector 28 of the comparative example.

The target collector 28 of the first embodiment may also include the radiation member 7.

The radiation member 7 may be a member configured to reflect heat radiation from the tank 281, the collection unit 282, and the heater 283.

The radiation member 7 may be formed in a plate shape.

The radiation member 7 may be disposed to cover at least a part of the tank 281 connected with the heater 283. The radiation member 7 may be disposed to cover at least a part of the collection unit 282 connected with the heater 283. The radiation member 7 may be disposed facing the tank 281 and the collection unit 282, connected with the heater 283, in almost parallel. There may be a space between the radiation member 7 and each of the tank 281, the collection unit 282, and the heater 283.

The radiation member 7 may be disposed between the casing 287 and each of the tank 281 and the collection unit 282 that are connected with the heater 283. The radiation member 7 may be held by the casing 287 via a support member, not illustrated, made of a material that resists heat conduction.

At least a surface on the tank 281 side of the radiation member 7 may be formed to have low emissivity with which heat radiation from the tank 281, the collection unit 282, and the heater 283 can be reflected. The emissivity may be 0.01 or higher but 0.1 or lower, for example.

The radiation member 7 itself may be made of a material having emissivity of 0.01 or higher but 0.1 or lower.

Alternatively, the radiation member 7 may be formed such that a surface of a bulk-shaped plate member is coated with a material having emissivity of 0.01 or higher but 0.1 or lower. A method of coating the radiation member 7 may be at least one of plating, thermal spraying, and vapor deposition.

The material constituting at least a surface on the tank 281 side of the radiation member 7 may be at least one of aluminum, tungsten, platinum, gold, silver, copper, brass, and nickel.

At least the surface on the tank 281 side of the radiation member 7 may be processed to have a surface roughness with gloss. The surface at least on the tank 281 side of the radiation member 7 may be polished to have a surface roughness forming a mirror.

As an example, the radiation member 7 may be formed in such a manner as to apply electroless nickel plating to a surface of a SUS316 plate member having a plate thickness of 0.5 mm and polish the surface, to which nickel plating is applied, to have a surface roughness forming a mirror.

The emissivity of the radiation member 7 may be 0.05 or higher but 0.1 or lower.

The casing 287 of the first embodiment may accommodate the tank 281 and the collection unit 282 that are connected with the heater 283, and the radiation member 7.

The other part of the configuration of the casing 287 according to the first embodiment may be the same as that of the casing 287 of the comparative example.

The other part of the configuration of the target collector 28 according to the first embodiment may be the same as that of the target collector 28 of the comparative example.

[4.2 Operation and Effect]

The radiation member 7 may reflect heat radiation from the tank 281, the collection unit 282, and the heater 283, toward the tank 281 and the collection unit 282. The radiation member 7 may add the heat that used to be dissipated to the casing 287 side by the heat radiation from the tank 281, the collection unit 282, and the heater 283, to the tank 281 and the collection unit 282. In other words, the radiation member 7 may suppress heat dissipation by the heat radiation from the tank 281, the collection unit 282, and the heater 283.

This means a portion far from the heater 283, of the tank 281 and the collection unit 282, may also be heated not only by the heat conduction from the heater 283 but also by the heat radiation reflected by the radiation member 7. Accordingly, in the tank 281 and the collection unit 282, a temperature difference between a portion close to the heater 283 and a portion far from the heater 283 may be remarkably smaller, compared with the case of not including the radiation member 7.

Thereby, the target collector 28 of the first embodiment can maintain the temperature of the tank 281 and the collection unit 282 almost uniformly at the temperature equal to or higher than the melting point of the target 27, while suppressing output of the heater 283.

Consequently, the target collector 28 of the first embodiment can suppress fixing of the target 27 on the walls of the tank 281 and the collection unit 282 while suppressing output of the heater 283.

5. Second Embodiment

[5.1 Configuration]

A target storage device of a second embodiment will be described with use of FIG. 5. Specifically, a target collector 28 of the second embodiment will be described as an exemplary target storage device of the second embodiment.

Figure 5:
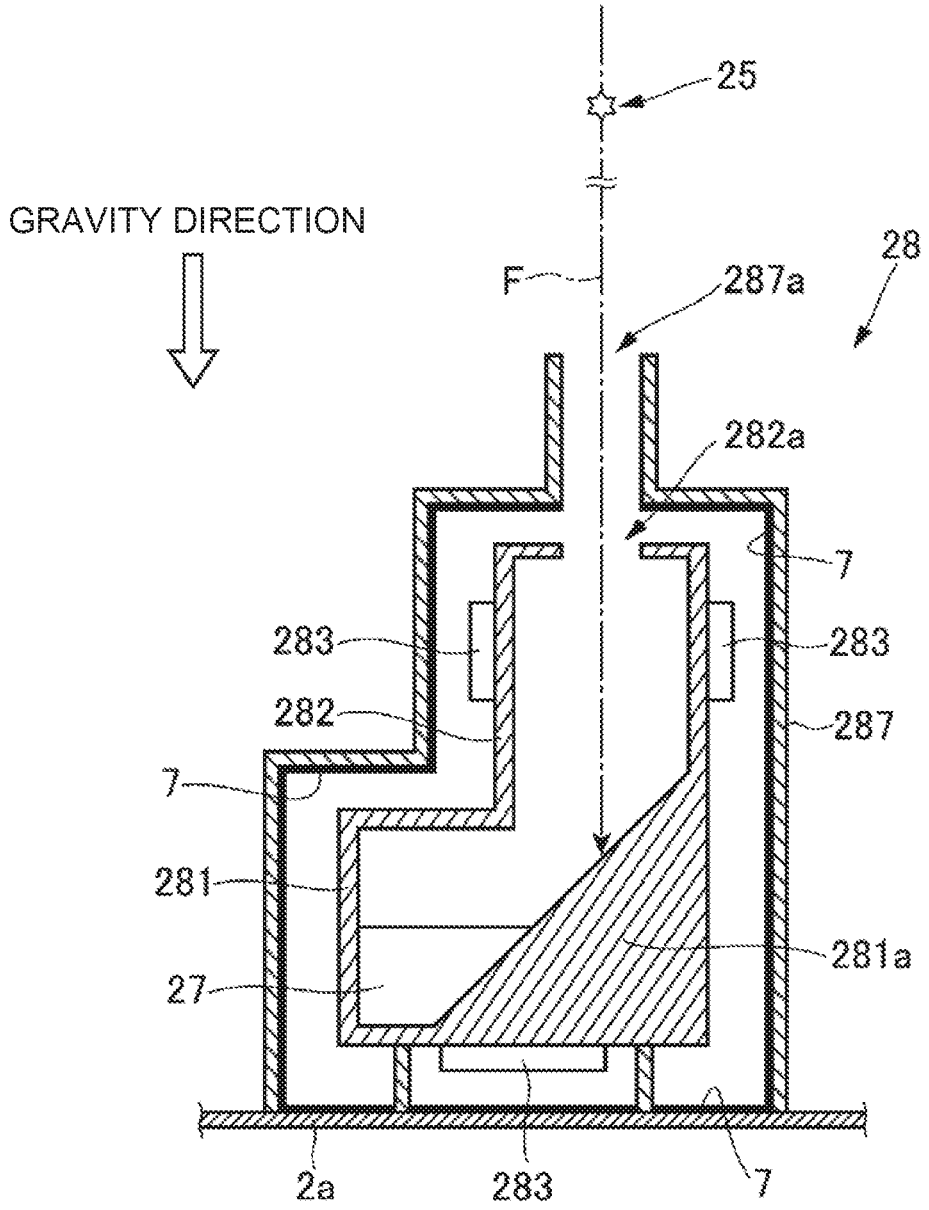
FIG. 5 is a drawing for explaining a target collector that is an example of a target storage device of a second embodiment.

FIG. 5 is a drawing for explaining the target collector 28 that is an exemplary target storage device of the second embodiment.

The target collector 28 of the second embodiment may be mainly different from the target collector 28 of the first embodiment in the configuration of the radiation member 7.

The radiation member 7 of the second embodiment may be formed on the inner surface of the casing 287, rather than being held by the casing 287 via a support member made of a material having low heat conductivity.

The radiation member 7 of the second embodiment may be formed in such a manner that the inner surface of the casing 287 is coated with a material having emissivity of 0.01 or higher but 0.1 or lower.

The other part of the configuration of the radiation member 7 according to the second embodiment may be the same as that of the radiation member 7 of the first embodiment.

The other part of the configuration of the target collector 28 according to the second embodiment may be the same as that of the target collector 28 of the first embodiment.

[5.2 Operation and Effect]

In the target collector 28 of the second embodiment, since the radiation member 7 is formed on the inner surface of the casing 287, the inner surface of the casing 287 may also work as the radiation member 7.

Thereby, in the target collector 28 of the second embodiment, a support member that supports the radiation member 7 may be omitted.

Consequently, regarding the target collector 28 of the second embodiment, the device configuration can be simplified and the size can be reduced, compared with the target collector 28 of the first embodiment.

6. Third Embodiment

[6.1 Configuration]

A target storage device of a third embodiment will be described with reference to FIG. 6. Specifically, a target collector 28 of the third embodiment will be described as an exemplary target storage device of the third embodiment.

Figure 6:
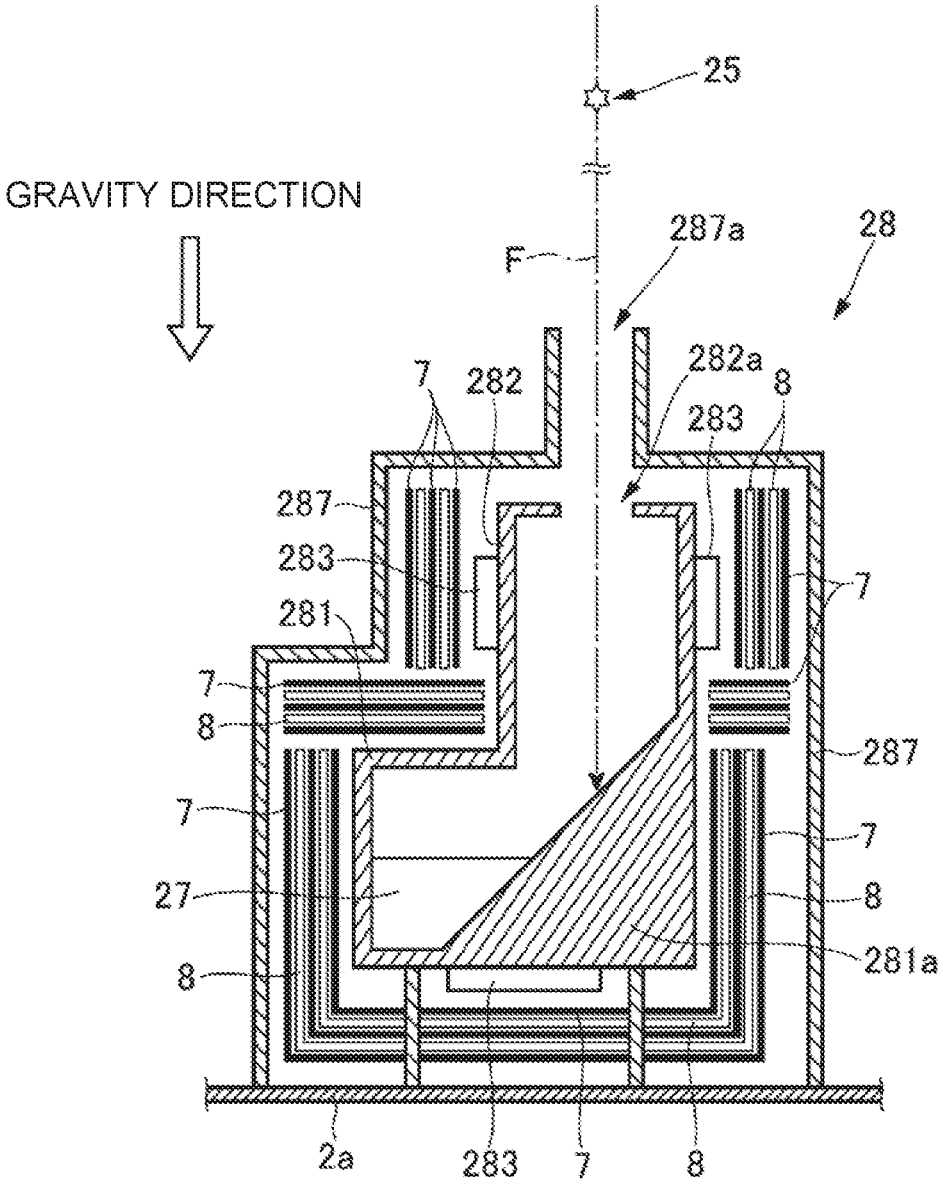
FIG. 6 is a drawing for explaining a target collector that is an example of a target storage device of a third embodiment.

FIG. 6 is a drawing for explaining the target collector 28 that is an exemplary target storage device of the third embodiment.

The target collector 28 of the third embodiment is mainly different from the target collector 28 of the first embodiment in the configuration of the radiation member 7. Further, the target collector 28 may have a configuration in which a heat insulating member 8 is added to the target collector 28 of the first embodiment.

The radiation member 7 of the third embodiment may be configured of a plurality of radiation members 7.

The radiation members 7 may be disposed with a space between each other. The respective radiation members 7 may be disposed to be layered from the tank 281 and the collection unit 282, connected with the heater 283, toward the casing 287 side. The number of layers of the radiation members 7 may be four or five. As the number of layers of the radiation members 7 is larger, heat dissipation by the heat radiation from the tank 281, the collection unit 282, and the heater 283 can be suppressed easily.

The other part of the configuration of the radiation member 7 according to the third embodiment may be the same as that of the radiation member 7 of the first embodiment.

The heat insulating member 8 may be disposed to fill the space between the radiation members 7.

The heat insulating member 8 may be made with use of a material that resists heat conduction. The heat insulating member 8 may be made with use of a material having high heat resistance. The heat insulating member 8 may be made of quartz or machinable ceramic.

The heat insulating member 8 may be formed in a fibrous state, a cloth state, a plate state, or a film state.

Further, the heat insulating member 8 may be disposed in a space between the radiation member 7 and the casing 287. Specifically, the heat insulating member 8 may be disposed in a space between the radiation member 7 located nearest to the casing 287 side among the radiation members 7, and the casing 287.

The temperature of the radiation member 7 located nearest to the casing 287 side, among the radiation members 7, may become lower than that of the other radiation members 7.

Accordingly, the heat insulating member 8 may be made with use of a resin material. The heat insulating member 8 may be a Kapton film.

The other part of the configuration of the target collector 28 according to the third embodiment may be the same as that of the target collector 28 of the first embodiment.

[6.2 Operation and Effect]

The radiation members 7 can suppress heat dissipation by heat radiation from the tank 281, the collection unit 282, and the heater 283 more, as the number of layers of the radiation members 7 is larger.

The heat insulating member 8 can suppress movement of heat between the radiation members 7. In the case where the heat insulating member 8 is disposed in a space between the radiation member 7 and the casing 287, the heat insulating member 8 may suppress movement of heat from the radiation member 7 to the casing 287.

Accordingly, the target collector 28 of the third embodiment can further suppress heat dissipation by heat radiation from the tank 281, the collection unit 282, and the heater 283, compared with the target collector 28 of the first embodiment.

Thereby, the target collector 28 of the third embodiment can further maintain the temperature of the tank 281 and the collection unit 282 almost uniformly at the temperature equal to or higher than the melting point of the target 27, while suppressing output of the heater 283, compared with the target collector 28 of the first embodiment.

Consequently, the target collector 28 of the third embodiment can further suppress fixing of the target 27 on the walls of the tank 281 and the collection unit 282, while suppressing output of the heater 283, compared with the target collector 28 of the first embodiment.

7. Fourth Embodiment

[7.1 Configuration]

A target storage device of a fourth embodiment will be described with use of FIG. 7. Specifically, a target collector 28 of the fourth embodiment will be described as an exemplary target storage device of the fourth embodiment.

Figure 7:
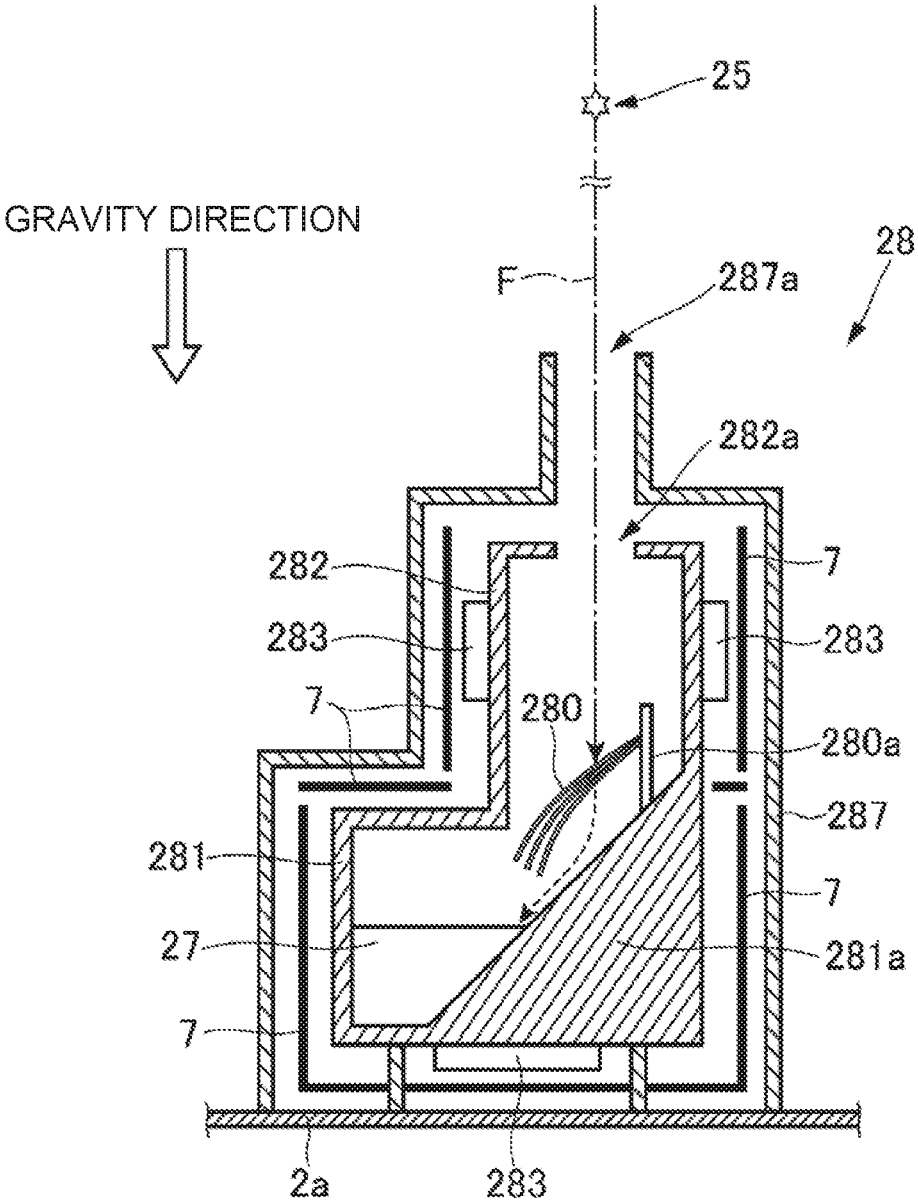
FIG. 7 is a drawing for explaining a target collector that is an example of a target storage device of a fourth embodiment.

FIG. 7 is a drawing for explaining the target collector 28 that is an exemplary target storage device of the fourth embodiment.

The target collector 28 of the fourth embodiment may have a configuration in which a receiver 280 is added to the target collector 28 of the first embodiment.

The receiver 280 may be a member that allows the target 27, not irradiated with the pulse laser light 33, to collide with and receives it.

The receiver 280 may be an elastic body configured with use of a fibrous member.

The receiver 280 may be made with use of a material that resists chemical reaction with the target 27.

The receiver 280 may be made with use of a material that resists being got wet by the molten target 27. The receiver 280 may be made with use of a material, the contact angle of which with the molten target 27 is equal to or larger than 90° but equal to or smaller than 180°.

The receiver 280 may be made with use of a material having heat resistance to the temperature equal to or higher than the melting point of the target 27.

When the target 27 is tin, the receiver 280 may be configured by bundling at least one of carbon fibers and tungsten thin wires.

The receiver 280 may be disposed at a position crossing the target trajectory F.

The receiver 280 may be disposed to be inclined with respect to the target trajectory F. The receiver 280 may be disposed such that the inclination angle against the target trajectory F is an angle other than 90°.

The receiver 280 may be disposed inside at least one of the tank 281 and the collection unit 282.

One end portion of the receiver 280 may be a fixed end supported by the inclined portion 281*a* via a support member 280*a*. The other end portion of the receiver 280 may be a free end.

The receiver 280 may be heated indirectly by the heater 283 via the tank 281 or the collection unit 282. Alternatively, the receiver 280 may be heated directly by a heater not illustrated. The receiver 280 may be heated to the temperature equal to or higher than the melting point of the target 27.

The other part of the configuration of the target collector 28 according to the fourth embodiment may be the same as that of the target collector 28 of the first embodiment.

[7.2 Operation and Effect]

As the receiver 280 is an elastic body of a fibrous member, when the target 27 collides with it, it deforms to be deflected, whereby the kinetic energy of the collided target 27 may be reduced.

The target 27 in which the kinetic energy is reduced may penetrate the receiver 280, may flow downward through the inclined portion 281*a*, and be stored in the tank 281.

This means that since the kinetic energy of the target 27 is reduced by the receiver 280, it may be possible to suppress the target 27 to be scattered as a splash when it collides with the inclined portion 281*a*, and the target 27 may be stored in the tank 281.

Even if the target 27 penetrating the receiver 280 becomes a splash and is scattered when it collides with the inclined portion 281*a*, the scattered target 27 may adhere to the receiver 280 that is an elastic body of a fibrous member and may be collected.

Since the receiver 280 is heated to the temperature equal to or higher than the melting point of the target 27, the collected target 27 may not be fixed to the receiver 280, may flow downward through the receiver 280, and may be stored in the tank 281.

Thereby, the target collector 28 of the fourth embodiment can suppress fixing of the target 27 on the walls of the tank 281 and collection unit 282 more reliably than the target collector 28 of the first embodiment.

In addition, since the target collector 28 of the fourth embodiment includes the radiation member 7, it is possible to maintain the temperature of the receiver 280 almost uniformly at the temperature equal to or higher than the melting point of the target 27 without increasing the output of the heater 283.

Consequently, the target collector 28 of the fourth embodiment can suppress fixing of the target 27 on the walls of the tank 281 and the collection unit 282 while suppressing output of the heater 283.

8. Fifth Embodiment

A target storage device of a fifth embodiment will be described with reference to FIG. 8. Specifically, a target collector 28 of the fifth embodiment will be described as an exemplary target storage device of the fifth embodiment.

The EUV light generation device 1 may cause the direction of leading the EUV light 252 from the chamber 2 toward the exposure device 6 to be inclined with respect to the horizontal direction. As such, the chamber 2 in a substantially cylindrical shape may be provided such that the center axial direction thereof is inclined with respect to the horizontal direction.

The target supply unit 26, provided on a lateral face portion of the chamber 2, may output the target 27 such that the target trajectory F is inclined with respect to the gravity direction.

The target collector 28 of the fifth embodiment may be disposed on the extended line of the target trajectory F inclined with respect to the gravity direction.

Regarding the configuration of the target collector 28 of the fifth embodiment, description of the same part as that of the target collector 28 of the fourth embodiment is omitted.

[8.1 Configuration]

Figure 8:
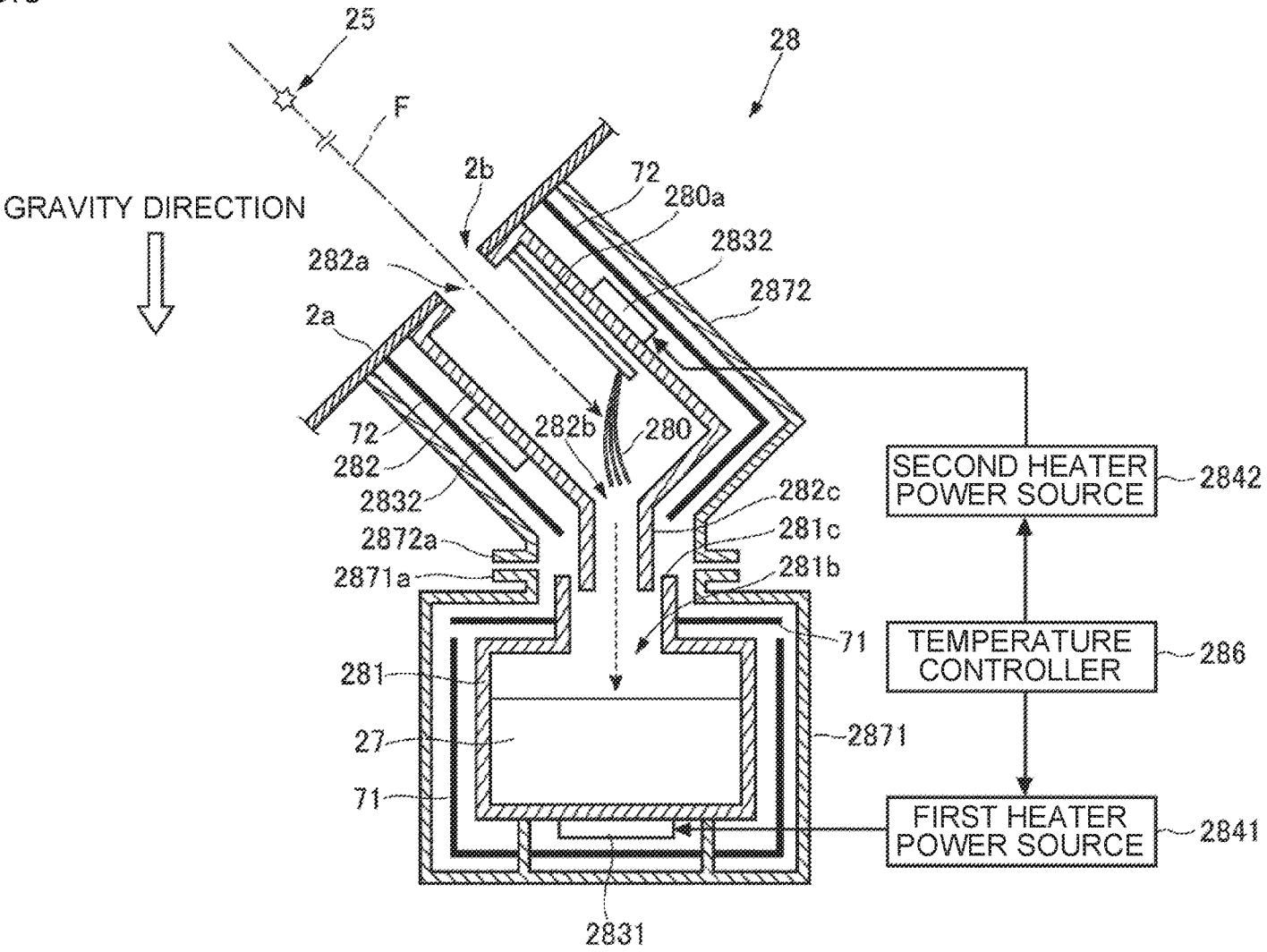
FIG. 8 is a drawing for explaining a target collector that is an example of a target storage device of a fifth embodiment.

FIG. 8 is a diagram for explaining the target collector 28 that is an exemplary target storage device of the fifth embodiment. Although the temperature sensor 285 and the EUV light generation controller 5 are illustrated in FIG. 3, they are abbreviated in FIG. 8.

The target collector 28 of the fifth embodiment may be disposed outside the chamber 2.

The target collector 28 of the fifth embodiment may be formed such that the tank 281 is attachable to and detachable from the collection unit 282.

In the target collector 28 of the fifth embodiment, the heater 283 may heat each of the tank 281 and the collection unit 282 independently.

The target collector 28 of the fifth embodiment may include the tank 281, the collection unit 282, the heater 283, the heater power source 284, the temperature sensor 285, the temperature controller 286, the casing 287, the radiation member 7, and the receiver 280.

The collection unit 282 of the fifth embodiment may be formed in a cylindrical shape extending along the target trajectory F inclined with respect to the gravity direction.

The center axis of the collection unit 282 may substantially match the target trajectory F inclined with respect to the gravity direction.

An end portion on the plasma generation region 25 side of the collection unit 282 may be connected with an outer surface of the wall 2*a* of the chamber 2. The opening 282*a* formed in the end portion on the plasma generation region 25 side of the collection unit 282 may communicate with a through hole 2*b* formed in the wall 2*a* crossing the target trajectory F.

An end portion on the tank 281 side of the collection unit 282 may be separated from the tank 281.

The end portion on the tank 281 side of the collection unit 282 may have an opening 282*b*.

The opening 282*a* may be an outlet for allowing the target 27, colliding with the receiver 280, to pass through toward the tank 281. The opening 282*b* may be formed on the extended line in the gravity direction on the basis of the receiver 280 disposed in the collection unit 282. The opening 282*b* may be formed immediately below the receiver 280. The opening 282*b* may be formed to be open to the tank 281. The opening 282*b* may be opened to the gravity direction. The opening 282*b* may communicate with an opening 281*b* formed in the end portion on the collection unit 282 side of the tank 281.

On the peripheral edge of the opening 282*b* of the collection unit 282, a communication path 282*c* may be formed. The communication path 282*c* may be formed to extend from the peripheral edge of the opening 282*b* toward the opening 281*b* of the tank 281. The communication path 282*c* may be formed to extend toward the gravity direction.

The other part of the configuration of the collection unit 282 according to the fifth embodiment may be the same as that of the collection unit 282 of the fourth embodiment.

The tank 281 of the fifth embodiment may be a container formed in a cylindrical shape extending along the gravity direction.

The tank 281 may not include the inclined portion 281*a*.

The end portion on the collection unit 282 side of the tank 281 may be separated from the collection unit 282.

The end portion on the collection unit 282 of the tank 281 may have the opening 281*b*.

The opening 281*b* may be an inlet for allowing the target 27, passing through the collection unit 282, to enter the tank 281. The opening 281*b* may be formed on the extended line in the gravity direction on the basis of the receiver 280 disposed in the collection unit 282. The opening 281*b* may be formed to be open to the collection unit 282. The opening 281*b* may be formed to be open to the opposite direction of the gravity direction. The opening 281*b* may communicate with the opening 282*b* formed in the end portion on the tank 281 side of the collection unit 282.

On the peripheral edge of the opening 281*b* of the tank 281, a communication path 281*c* may be formed. The communication path 281*c* may be formed to extend from the peripheral edge of the opening 281*b* to the opening 282*b* of the collection unit 282. The communication path 281*c* may be formed to extend toward the opposite direction of the gravity direction.

The communication path 281*c* may be formed in a shape fitting to the communication path 282*c* of the collection unit 282. The inner diameter of the communication path 281*c* may be larger than the outer diameter of the communication path 282*c* of the collection unit 282, as illustrated in FIG. 8. Alternatively, although not illustrated, the outer diameter of the communication path 281*c* may be smaller than the inner diameter of the communication path 282*c* of the collection unit 282.

The other part of the configuration of the tank 281 according to the fifth embodiment may be the same as that of the tank 281 of the fourth embodiment.

The heater 283 of the fifth embodiment may include at least a first heater 2831 and a second heater 2832.

The first heater 2831 and the second heater 2832 may be independent of each other.

The first heater 2831 may heat the tank 281.

The first heater 2831 may be connected with the tank 281. The first heater 2831 may be disposed to cover the outer surface of the tank 281.

The first heater 2831 may be connected with a first heater power source 2841.

The second heater 2832 may heat the collection unit 282.

The second heater 2832 may be connected with the collection unit 282. The second heater 2832 may be disposed to cover the outer surface of the collection unit 282.

The second heater 2832 may be connected with a second heater power source 2842.

The other part of the configuration of each of the first heater 2831 and the second heater 2832 according to the fifth embodiment may be the same as that of the heater 283 of the fourth embodiment.

The temperature sensor 285 of the fifth embodiment may be disposed to each of the tank 281 and the collection unit 282, although not illustrated.

The heater power source 284 according to the fifth embodiment may include at least the first heater power source 2841 and the second heater power source 2842.

The first heater power source 2841 and the second heater power source 2842 may be independent of each other.

The first heater power source 2841 may be a power source that supplies electric power to the first heater 2831.

Operation of the first heater power source 2841 may be controlled by the temperature controller 286.

The second heater power source 2842 may be a power source that supplies electric power to the second heater 2832.

Operation of the second heater power source 2842 may be controlled by the temperature controller 286.

The other part of the configuration of each of the first heater power source 2841 and the second heater power source 2842 according to the fifth embodiment may be the same as that of the heater power source 284 of the fourth embodiment.

The temperature controller 286 of the fifth embodiment may control operation of each of the first heater power source 2841 and the second heater power source 2842 independently.

The temperature controller 286 may be connected with each of the first heater power source 2841 and the second heater power source 2842.

The other part of the configuration of the temperature controller 286 according to the fifth embodiment may be the same as that of the temperature controller 286 of the fourth embodiment.

The casing 287 of the fifth embodiment may include at least a first casing 2871 and a second casing 2872.

The first casing 2871 and the second casing 2872 may be disposed outside the chamber 2.

The first casing 2871 and the second casing 2872 may be configured to be separable from each other.

The second casing 2872 may accommodate the collection unit 282 connected with the second heater 2832, and a second radiation member 72.

An end portion on the plasma generation region 25 side of the second casing 2872 may be connected with the outer surface of the wall 2*a* of the chamber 2.

On an end portion on the tank 281 side of the second casing 2872, a flange 2872*a* may be formed around the communication path 282*c* of the collection unit 282.

The first casing 2871 may accommodate the tank 281 connected with the first heater 2831, and a first radiation member 71.

On an end portion on the collection unit 282 side of the first casing 2871, a flange 2871*a* may be formed around the communication path 281*c* of the tank 281. The flange 2871*a* may be linked to the flange 2872*a* of the second casing 2872 detachably via a bolt not illustrated. The flange 2871*a* and the flange 2872*a* may be configured to be connectable airtightly.

An end portion, opposite to the collection unit 282, of the first casing 2871 may support the tank 281.

The other part of the configuration of each of the first casing 2871 and the second casing 2872 according to the fifth embodiment may be the same as that of the casing 287 of the fourth embodiment.

The radiation member 7 of the fifth embodiment may include at least the first radiation member 71 and the second radiation member 72.

The first radiation member 71 may be a member configured to reflect heat radiation from the tank 281 and the first heater 2831.

The first radiation member 71 may be arranged to cover at least a part of the tank 281 connected with the first heater 2831. The first radiation member 71 may be disposed facing the tank 281 connected with the first heater 2831 in almost parallel. The first radiation member 71 may be disposed with a space between it and each of the tank 281 and the first heater 2831.

The first radiation member 71 may be disposed between the tank 281 connected with the first heater 2831 and the first casing 2871. The first radiation member 71 may be held by the first casing 2871 via a support member, not illustrated, made of a material that resists heat conduction.

At least a surface on the tank 281 side of the first radiation member 71 may be formed to have low emissivity so as to be able to reflect heat radiation from the tank 281 and the first heater 2831. The emissivity may be 0.01 or higher but 0.1 or lower, for example.

The first radiation member 71 may be made of a material having emissivity of 0.01 or higher but 0.1 or lower.

Alternatively, the first radiation member 71 may be formed such that a surface of a plate member in a bulk shape is coated with a material having emissivity of 0.01 or higher but 0.1 or lower.

The material constituting at least the surface on the tank 281 side of the first radiation member 71 may be at least one of aluminum, tungsten, platinum, gold, silver, copper, brass, and nickel.

At least the surface on the tank 281 side of the first radiation member 71 may be processed to have a surface roughness with gloss. At least the surface on the tank 281 side of the radiation member 71 may be polished to have a surface roughness forming a mirror.

The other part of the configuration of the first radiation member 71 may be the same as that of the radiation member 7 of the fourth embodiment.

The second radiation member 72 may be a member configured to reflect eat radiation from the collection unit 282 and the second heater 2832.

The second radiation member 72 may be disposed to cover at least a part of the collection unit 282 connected with the second heater 2832. The second radiation member 72 may be disposed to face the collection unit 282 connected with the second heater 2832 in almost parallel. The second radiation member 72 may be disposed with a space between it and each of the collection unit 282 and the second heater 2832.

The second radiation member 72 may be disposed between the collection unit 282 connected with the second heater 2832 and the second casing 2872. The second radiation member 72 may be held by the second casing 2872 via a support member, not illustrated, made of a material that resists heat conduction.

At least the surface on the collection unit 282 side of the second radiation member 72 may be formed to have low emissivity so as to be able to reflect heat radiation from the collection unit 282 and the second heater 2832. The emissivity may be 0.01 or higher but 0.1 or lower, for example.

The second radiation member 72 may be made of a material having emissivity of 0.01 or higher but 0.1 or lower.

Alternatively, the second radiation member 72 may be formed such that a surface of a plate member in a bulk shape is coated with a material having emissivity of 0.01 or higher but 0.1 or lower.

The material constituting at least the surface on the collection unit 282 side of the second radiation member 72 may be at least one of aluminum, tungsten, platinum, gold, silver, copper, brass, and nickel.

At least the surface on the collection unit 282 side of the second radiation member 72 may be processed to have a surface roughness with gloss. At least the surface on the collection unit 282 side of the second radiation member 72 may be polished to have a surface roughness forming a mirror.

The other part of the configuration of the second radiation member 72 may be the same as that of the radiation member 7 of the fourth embodiment.

The receiver 280 of the fifth embodiment may be disposed in the collection unit 282.

The support member 280*a* supporting an end portion of the receiver 280 may be fixed to the collection unit 282.

The receiver 280 may be heated indirectly by the second heater 2832 via the collection unit 282. Alternatively, the receiver 280 may be heated directly by a heater not illustrated. The receiver 280 may be heated to the temperature equal to or higher than the melting point of the target 27.

The other part of the configuration of the receiver 280 according to the fifth embodiment may be the same as that of the receiver 280 of the fourth embodiment.

The other part of the configuration of the target collector 28 of the fifth embodiment may be the same as that of the target collector 28 of the fourth embodiment.

[8.2 Operation]

Operation of the target collector 28 of the fifth embodiment will be described.

Regarding the operation of the target collector 28 of the fifth embodiment, description of the same operation as that of the target collector 28 of the comparative example and the fourth embodiment is omitted.

The temperature controller 286 may control electric power supplied from the first heater power source 2841 to the first heater 2831 such that a detection value indicated by a temperature detection signal from the temperature sensor 285 connected with the tank 281 approaches the target temperature.

The temperature controller 286 may control electric power supplied from the second heater power source 2842 to the second heater 2832 such that a detection value indicated by a temperature detection signal from the temperature sensor 285 connected with the collection unit 282 approaches the target temperature.

When the target 27 is tin, the target temperature of each of the tank 281 and the collection unit 282 may be temperature in a range from 240° C. to 400° C., for example. For example, the target temperature of each of the tank 281 and the collection unit 282 may be 370° C.

In that case, temperature of the tank 281 and the collection unit 282 can be maintained at about 370° C. that is equal to or higher than the melting point of the target 27. The temperature of the receiver 280 can be maintained at about 290° C. that is equal to or higher than the melting point of the target 27.

The target 27 in the tank 281 and the collection unit 282 and the target 27 colliding with the receiver 280 can be in a molten state.

It should be noted that the target temperature of the tank 281 may be different from the target temperature of the collection unit 282.

The target 27 not irradiated with the pulse laser light 33 may pass through the through hole 2*b* formed in the wall 2*a* of the chamber 2 and enter the collection unit 282 from the opening 282*a*. The target 27 entering the collection unit 282 may collide with the receiver 280, and the kinetic energy may be reduced.

The target 27 in which the kinetic energy is reduced flows downward in the gravity direction and may enter the opening 282*b* and the communication path 282*c*. At that time, the target 27 may flow downward through the receiver 280, or flow downward along the wall of the collection unit 282 after penetrating the receiver 280, and may enter the opening 282*b* and the communication path 282*c*.

The target 27 entering the opening 282*b* and the communication path 282*c* may pass through the opening 282*b*, the communication path 282*c*, the communication path 281*c*, and the opening 281*b* sequentially, and may be stored in the tank 281.

The other operation of the target collector 28 of the fifth embodiment may be the same as that of the target collector 28 of the comparative example and the fourth embodiment.

[8.3 Effect]

In the target collector 28 of the fifth embodiment, the tank 281 and the collection unit 282 may be formed separately from each other and the tank 281 may be formed detachably from the collection unit 282.

Thereby, in the target collector 28 of the fifth embodiment, it is possible to replace only the tank 281. Accordingly, the downtime at the time of maintenance can be reduced, and the operation time of the target collector 28 can be increased.

In addition, in the target collector 28 of the fifth embodiment, the shapes of the tank 281 and the collection unit 282 may be formed to fit the respective functions of the tank 281 and the collection unit 282. This means that in the target collector 28 of the fifth embodiment, the shape of the collection unit 282 can be formed to have a desired capacity necessary for disposing the receiver 280. In the target collector 28 of the fifth embodiment, the shape of the tank 281 can be formed to have a desired capacity necessary for storing the target 27. This can be particularly effective in the case where the target trajectory F is inclined with respect to the gravity direction.

Further, the target collector 28 of the fifth embodiment may heat the tank 281 and the collection unit 282 independently from each other.

Thereby, the target collector 28 of the fifth embodiment may heat each of the tank 281 and the collection unit 282 to have a temperature suitable for each function of the tank 281 and the collection unit 282.

This means that the target collector 28 of the fifth embodiment can regulate output of the first heater 2831 configured to heat the tank 281 such that the temperature of the tank 281 becomes desired temperature necessary for melting the target 27. The target collector 28 of the fifth embodiment can regulate output of the second heater 2832 configured to heat the collection unit 282 such that not only the temperature of the collection unit 282 but also the temperature of the receiver 280 in the collection unit 282 become the temperature equal to or higher than the melting point of the target 27.

Further, as the target collector 28 of the fifth embodiment has the first radiation member 71 and the second radiation member 72, it is possible to maintain the temperature of the tank 281 and the collection unit 282 at the temperature equal to or higher than the melting point of the target 27 almost uniformly, while suppressing output of the first heater 2831 and the second heater 2832.

Further, as the target collector 28 of the fifth embodiment has the receiver 280, it is possible to suppress fixing of the target 27 on the walls of the tank 281 and the collection unit 282 more effectively, compared with the case of not including the receiver 280.

In view of the above, the target collector 28 of the fifth embodiment is able to suppress fixing of the target 27 on the walls of the tank 281 and the collection unit 282, while suppressing output of the heater 283.

9. Sixth Embodiment

A target storage device of a sixth embodiment will be described with use of FIG. 9. Specifically, a target supply unit 26 of the sixth embodiment will be described as an exemplary target storage device of the sixth embodiment.

The target supply unit 26 of the sixth embodiment may have a configuration in which the radiation member 7 is added to the target supply unit 26 of the comparative example.

Regarding the configuration of the target supply unit 26 of the sixth embodiment, description of the same configuration as that of the target supply unit 26 of the comparative example is omitted.

[9.1 Configuration]

Figure 9:
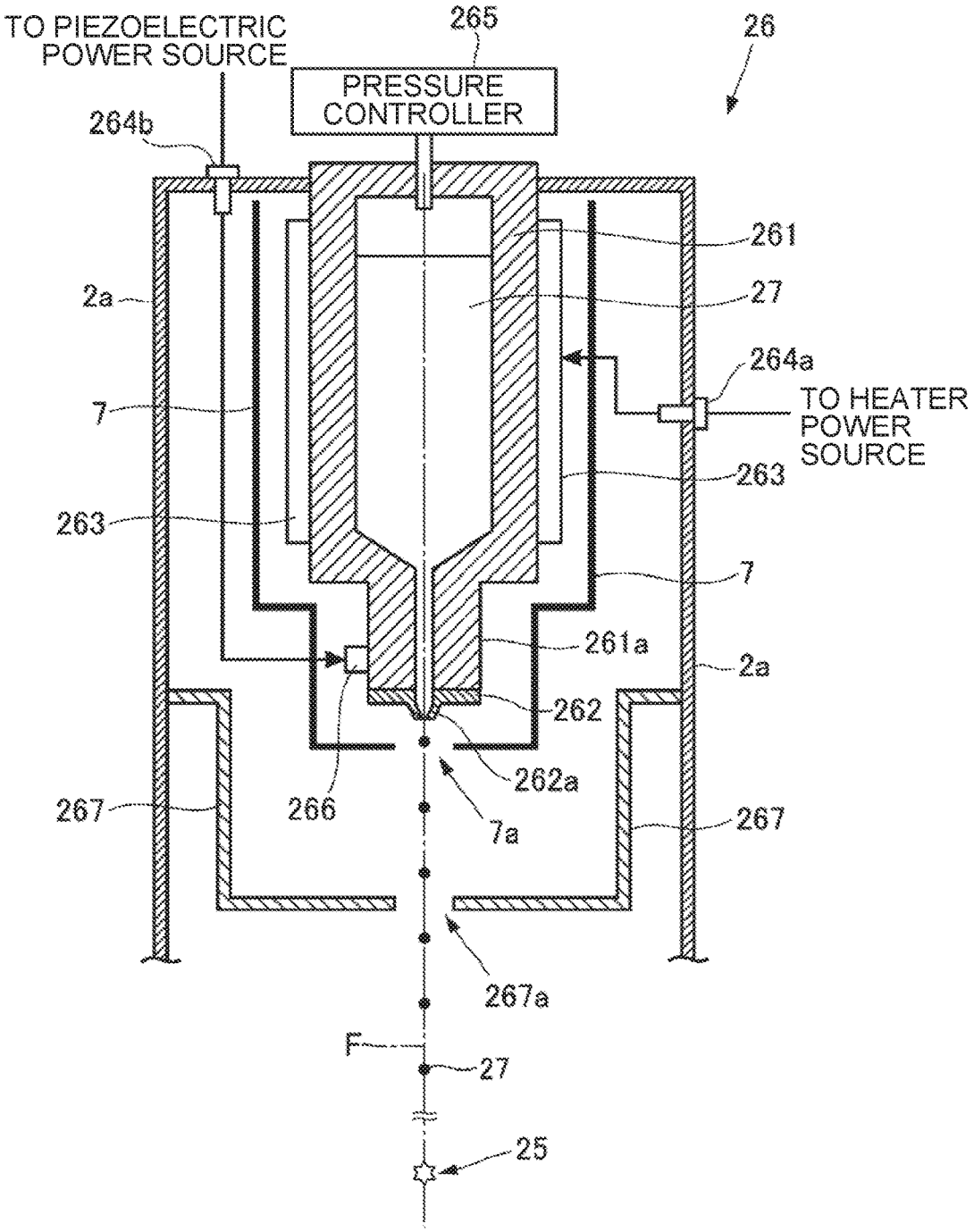
FIG. 9 is a drawing for explaining a target supply unit that is an example of a target storage device of a sixth embodiment.

FIG. 9 is a drawing for explaining the target supply unit 26 that is an exemplary target storage device of the sixth embodiment.

The target supply unit 26 of the sixth embodiment may be a device configured to output the target 27 in a so-called continuous jet method.

The target supply unit 26 may be mounted to penetrate the wall 2*a* of the chamber 2.

The target supply unit 26 of the sixth embodiment may include the tank 261, the nozzle 262, the heater 263, feedthroughs 264*a* and 264*b*, a pressure controller 265, a piezoelectric element 266, a cover 267, and the radiation member 7.

The tank 261 may be a container configured to store the target 27 to be output into the chamber 2. The tank 261 may store the target 27 therein in a molten state.

The tank 261 may be made of a material that resists chemical reaction with the target 27.

The tank 261 may be made of a material that resists being got wet by the molten target 27. The tank 261 may be made of a material, the contact angle of which with the molten target 27 is equal to or larger than 90° but equal to or smaller than 180°.

The tank 261 may be made with use of a material having heat resistance to the temperature equal to or higher than the melting point of the target 27.

When the target 27 is tin, the tank 261 may be made with use of molybdenum or quartz, for example.

The tank 261 may be formed in a hollow cylindrical shape.

The tank 261 may be formed to extend along the target trajectory F. The tank 261 may be disposed such that the center axis thereof almost matches the target trajectory F.

The tank 261 may be disposed to penetrate the wall 2*a* of the chamber 2. The tank 261 may be connected with the wall 2*a* of the chamber 2 airtightly.

The nozzle 262 may be a member for outputting the target 27, stored in the tank 261, into the chamber 2.

The nozzle 262 may be made of a material that resists chemical reaction with the target 27.

The nozzle 262 may be made of a material that resists being got wet by the molten target 27. The nozzle 262 may be made with use of a material, the contact angle of which with the molten target 27 is equal to or larger than 90° but equal to or smaller than 180°.

The nozzle 262 may be made with use of a material having heat resistance to the temperature equal to or higher than the melting point of the target 27.

When the target 27 is tin, the nozzle 262 may be made with use of molybdenum or quartz, for example.

The nozzle 262 may be connected with the tank 261. The nozzle 262 may be connected to the tip of a neck portion 261*a* that is an end portion on the plasma generation region 25 side of the tank 261.

The nozzle 262 may be formed in a plate shape.

In the center of the nozzle 262, a nozzle hole 262*a* may be formed. The nozzle hole 262*a* may be formed to penetrate the nozzle 262. The nozzle hole 262*a* may be formed such that the center axis thereof substantially matches the target trajectory F.

A peripheral edge portion of the nozzle hole 262*a* of the nozzle 262 may be formed to protrude toward the plasma generation region 25. The nozzle hole 262*a* and the peripheral edge portion may be formed to be in a shape so as to eject the target 27 into the chamber 2 in the form of jet.

The heater 263 may heat the tank 261 and the nozzle 262.

The heater 263 may be connected with the tank 261. The heater 263 may be disposed so as to cover the outer surface of the tank 261.

The heater 263 may be connected with a heater power source, not illustrated, via the feedthrough 264*a*. The heater 263 may heat the tank 261 by electric power supplied from the heater power source. Operation of the heater power source may be controlled by the EUV light generation controller 5.

The pressure controller 265 may regulate the pressure applied to the target 27 in the tank 261.

The pressure controller 265 may be linked to the inside of the tank 261.

The pressure controller 265 may be linked to a gas cylinder not illustrated. The gas cylinder may be filled with inert gas such as helium or argon. The pressure controller 265 may supply inert gas in the gas cylinder into the tank 261.

The pressure controller 265 may have an exhaust port not illustrated. The pressure controller 265 may discharge gas in the tank 261 from the exhaust port.

The pressure controller 265 may regulate the pressure applied to the target 27 in the tank 261 by supplying the gas into the tank 261 or discharging the gas in the tank 261. Operation of the pressure controller 265 may be controlled by the EUV light generation controller 5.

The piezoelectric element 266 may apply vibration to the neck portion 261*a* of the tank 261.

The piezoelectric element 266 may be fixed to the outer lateral face portion of the neck portion 261*a* in an almost cylindrical shape.

The piezoelectric element 266 may be connected with a piezoelectric power source, not illustrated, via the feedthrough 264*b*. The piezoelectric element 266 may be vibrated by power supplied from the piezoelectric power source. Operation of the piezoelectric power source may be controlled by the EUV light generation controller 5.

The cover 267 may be a member that covers the tank 261 and the nozzle 262, connected with the heater 263, and the radiation member 7. The cover 267 may be a member that shields the tank 261 and the nozzle 262 from voltage fluctuation due to generation of plasma.

The cover 267 may be connected with the wall 2*a* of the chamber 2.

The cover 267 may be disposed on the target trajectory F between the nozzle 262 and the plasma generation region 25.

At the center of the cover 267, a through hole 267*a* may be formed. The through hole 267*a* may be a hole for allowing the target 27 output from the nozzle 262 to pass therethrough. The through hole 267*a* may be formed at a position crossing the target trajectory F in the cover 267.

The insides of the tank 261, the nozzle 262, the cover 67, and the chamber 2 may communicate with each other.

The radiation member 7 according to the sixth embodiment may be a member configured to reflect heat radiation from the tank 261, the nozzle 262, and the heater 263.

The radiation member 7 may be formed in a plate shape.

The radiation member 7 may be disposed to cover at least a part of the tank 261 connected with the heater 263 and the piezoelectric element 266. The radiation member 7 may be disposed to cover at least a part of the nozzle 262. The radiation member 7 may be disposed with a space between it and each of the tank 261, the nozzle 262, the heater 263, and the piezoelectric element 266.

The radiation member 7 may be disposed between the tank 261 connected with the heater 263 and the piezoelectric element 266 and the nozzle 262, and the wall 2*a* and the cover 267. The radiation member 7 may be held by the wall 2*a* via a support member, not illustrated, made of a material that resists heat conduction.

At the center of the radiation member 7, a through hole 7*a* may be formed. The through hole 7*a* may be a hole for allowing the target 27, output from the nozzle 262 and passing through the through hole 267*a*, to pass therethrough. The through hole 7*a* may be formed at a position crossing the target trajectory F in radiation member 7.

At least a surface on the tank 261 side of the radiation member 7 may be formed to have low emissivity such that heat radiation from the tank 261, the nozzle 262, and the heater 263 can be reflected. The emissivity may be 0.01 or higher but 0.1 or lower, for example.

The radiation member 7 may be made of a material having emissivity of 0.01 or higher but 0.1 or lower.

Alternatively, the radiation member 7 may be formed by coating the surface of a plate material in a bulk shape with a material having emissivity of 0.01 or higher but 0.1 or lower. A method of coating the radiation member 7 may be at least one of plating, thermal spraying, and vapor deposition.

The material forming at least the surface on the tank 261 side of the radiation member 7 may be at least one of aluminum, tungsten, platinum, gold, silver, copper, brass, and nickel.

The surface at least on the tank 261 side of the radiation member 7 may be processed to have a surface roughness with gloss. The surface at least on the tank 261 side of the radiation member 7 may be polished to have a surface roughness forming a mirror.

It should be noted that in the sixth embodiment, the nozzle 262, the tank 261 connected with the heater 263, and the radiation member 7 may be disposed in a space formed by a part of the wall 2*a* of the chamber 2 and the cover 267, as illustrated in FIG. 9.

A part of the wall 2*a* of the chamber 2 and the cover 267, constituting the space, may constitute the casing accommodating the nozzle 262, the tank 261 connected with the heater 263, and the radiation member 7.

This means that in the example of FIG. 9, the casing accommodating the nozzle 262, the tank 261 connected with the heater 263, and the radiation member 7 may be configured of a part of the wall 2*a* of the chamber 2 and the cover 267.

However, in the target supply unit 26 of the sixth embodiment, the casing accommodating the nozzle 262, the tank 261 connected with the heater 263, and the radiation member 7 may be provided as a member different from the wall 2*a* of the chamber 2.

In that case, the casing accommodating the nozzle 262, the tank 261 connected with the heater 263, and the radiation member 7 may be formed to have a shape similar to a part of the wall 2*a* of the chamber 2 and the cover 267 as described above illustrated in FIG. 9. Then, the casing may be connected with the wall 2*a* of the chamber 2, and a through hole for allowing the target 27 to pass therethrough may be formed at a position crossing the target trajectory F. Further, the casing may shield the tank 261 and the nozzle 262 from the EUV light 251 radiated from the plasma generation region 25.

[9.2 Operation]

Operation of the target supply unit 26 of the sixth embodiment will be described.

The EUV light generation controller 5 may control operation of the heater power source that supplies electric power to the heater 263 such that the temperature of the tank 261 and the nozzle 262 approaches the target temperature.

The target temperature of the tank 261 and the nozzle 262 may be the temperature equal to or higher than the melting point of the target 27 and at which the target 27 in the tank 261 and the nozzle 262 melts.

At this time, the radiation member 7 may reflect heat radiation from the tank 261, the nozzle 262, and the heater 263, toward the tank 261 and the nozzle 262. The radiation member 7 may add heat used to be dissipated to the wall 2*a* side of the chamber 2 by heat radiation from the tank 261, the nozzle 262, and the heater 263, to the tank 261 and the nozzle 262. In other words, the radiation member 7 may suppress heat dissipation caused by heat radiation from the tank 261, the nozzle 262, and the heater 263.

This means that in the tank 261 and the nozzle 262, a portion far from the heater 263 may be heated not only by heat conduction from the heater 263 but also heat radiation reflected by the radiation member 7. Accordingly, in the tank 261 and the nozzle 262, a temperature difference between a portion close to the heater 263 and a portion far from the heater 263 can be remarkably smaller than the case where there is no radiation member 7.

On the other hand, the EUV light generation controller 5 may control operation of the pressure controller 265 such that the pressure applied to the target 27 in the tank 261 becomes a target pressure.

A target pressure of the pressure applied to the target 27 may be a pressure with which the target 27 in the tank 261 is ejected from the nozzle hole 262*a* in the form of jet at a predetermined velocity.

The EUV light generation controller 5 may control operation of the piezoelectric power source that supplies electric power to the piezoelectric element 266 such that the piezoelectric element 266 vibrates the neck portion 261*a* of the tank 261 in a predetermined waveform.

The predetermined waveform may be a waveform with which a droplet is generated at a predetermined frequency.

The piezoelectric element 266 can vibrate the neck portion 261*a* at a predetermined waveform corresponding to the electric power in a predetermined waveform supplied from the piezoelectric power source. The nozzle 262 connected with the neck portion 261*a* may be vibrated with a predetermined waveform. Thereby, a standing wave is given to the target 27 in the form of jet ejected from the nozzle hole 262*a*, and the target 27 in the form of jet may be separated periodically. The separated target 27 may form a free interface by the own surface tension to form a droplet. As a result, a droplet may be formed at a predetermined frequency, and may be output into the chamber 2.

The target 27 output as a droplet advances on the target trajectory 1, and may pass through the through hole 7*a* of the radiation member 7 and the through hole 267*a* of the cover 267. The target 27 passing through the through hole 267*a* advances on the target trajectory F and may reach the plasma generation region 25.

[9.3 Effect]

As the target supply unit 26 of the sixth embodiment includes the radiation member 7, it is possible to maintain the temperature of the tank 261 and the nozzle 262 almost uniformly at the temperature equal to or higher than the melting point of the target 27, while suppressing output of the heater 263.

Consequently, the target supply unit 26 of the sixth embodiment can suppress fixing of the target 27 on the walls of the tank 261 and the nozzle 262, while suppressing output of the heater 263.

10. Others

[10.1 Hardware Environment of Each Controller]

A person skilled in the art will understand that the subject described herein can be implemented by combining a general purpose computer or a programmable controller and a program module or a software application. In general, a program module includes a routine, a program, a component, a data structure, and the like capable of implementing the processes described in the present disclosure.

Figure 10:
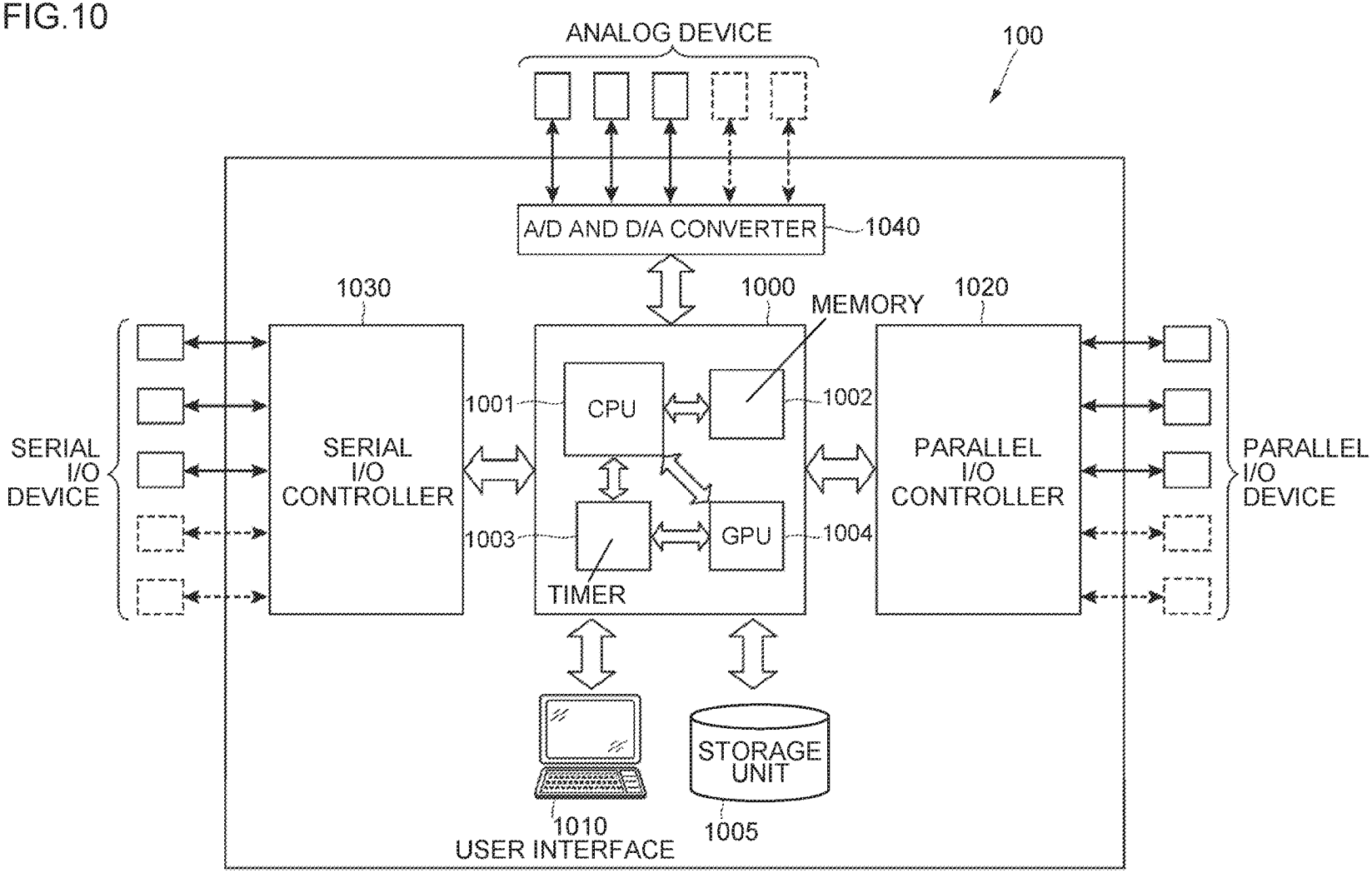
FIG. 10 is a block diagram for explaining a hardware environment of each control unit.

FIG. 10 is a block diagram illustrating an exemplary hardware environment in which various aspects of the disclosed subject can be implemented. An exemplary hardware environment 100 in FIG. 10 may include a processing unit 1000, a storage unit 1005, a user interface 1010, a parallel I/O (input/output) controller 1020, a serial I/O controller 1030, and an A/D and D/A (analog-to-digital and digital-to-analog) converter 1040. However, the configuration of the hardware environment 100 is not limited to this.

The processing unit 1000 may include a central processing unit (CPU) 1001, a memory 1002, a timer 1003, and an image processing unit (GPU) 1004. The memory 1002 may include a random access memory (RAM) and a read only memory (RUM). The CPU 1001 may be any commercially available processor. A dual microprocessor or another multiprocessor architecture may be used as the CPU 1001.

These constituent elements in FIG. 10 may be connected with each other to perform processes described in the present disclosure.

In the operation, the processing unit 1000 may read and execute a program stored in the storage unit 1005. The processing unit 1000 may also read data along with a program from the storage unit 1005. The processing unit 1000 may also write data to the storage unit 1005. The CPU 1001 may execute a program read from the storage unit 1005. The memory 1002 may be a work region for temporarily storing a program to be executed by the CPU 1001 and data used for operation of the CPU 1001. The timer 1003 may measure the time interval and output a measurement result to the CPU 1001 in accordance with execution of a program. The GPU 1004 may process image data according to a program read from the storage unit 1005, and output a processing result to the CPU 1001.

The parallel I/O controller 1020 may be connected with a parallel I/O device communicable with the processing unit 1000 such as the temperature controller 286 or the EUV light generation controller 5, and may control communications between the processing unit 1000 and such a parallel I/O device. The serial I/O controller 1030 may be connected with a serial I/O device communicable with the processing unit 1000 such as the laser light travel direction controller 34, the heater 263, the pressure controller 265, the heater 283, the first heater 2831, the second heater 2832, the heater power source 284, the first heater power source 2841, the second heater power source 2842, or the piezoelectric power source, and may control communications between the processing unit 1000 and such a serial I/O device. The A/D and D/A converter 1040 may be connected with an analog device such as the target sensor 4 or the temperature sensor 285 via an analog port, and may control communications between the processing unit 1000 and such an analog device, or perform A/D or D/A conversion of the communication content.

The user interface 1010 may display the progress of a program executed by the processing unit 1000 to the operator such that the operator can instruct the processing unit 1000 to stop the program or execute a cutoff routine.

The exemplary hardware environment 100 may be applied to the configurations of the temperature controller 286, the EUV light generation controller 5, and the like of the present disclosure. A person skilled in the art will understand that such controllers may be realized in a distributed computing environment, that is, an environment in which a task is executed by processing units connected over a communication network. In the present disclosure, the temperature controller 286, the EUV light generation controller 5, and the like may be connected with each other over a communication network such as Ethernet or the Internet. In a distributed computing environment, a program module may be stored in memory storage devices of both local and remote.

[10.2 Other Modifications and the Like]

It will be obvious to those skilled in the art that the techniques of the embodiments described above are applicable to each other including the modifications.

For example, the radiation member 7 of the second embodiment may be applied to the radiation member 7 of the fourth embodiment.

The radiation member 7 of the second embodiment may be applied to each of the first radiation member 71 and the second radiation member 72 of the fifth embodiment. In that case, the first radiation member 71 and the second radiation member 72 of the fifth embodiment may be formed on the inner surfaces of the first casing 2871 and the second casing 2872, respectively.

The radiation member 7 of the second embodiment may be applied to the radiation member 7 of the sixth embodiment. In that case, the radiation member 7 of the sixth embodiment may be formed on the inner surface of each of a part of the wall 2*a* of the chamber 2, accommodating the tank 261 and the nozzle 262 connected with the heater 263 and the radiation member 7, and the cover 267.

The radiation member 7 of the third embodiment may be applied to the radiation member 7 of the fourth embodiment. In that case, the heat insulating member 8 may be disposed in a space between the radiation members 7 of the fourth embodiment.

The radiation member 7 of the third embodiment may be applied to each of the first radiation member 71 and the second radiation member 72 of the fifth embodiment. In that case, the heat insulating member 8 may be disposed in a space between the first radiation members 71 of the fifth embodiment. The heat insulating member 8 may be disposed in a space between the second radiation members 72 of the fifth embodiment.

The radiation member 7 of the third embodiment may be applied to the radiation member 7 of the sixth embodiment. In that case, the heat insulating member 8 may be disposed in a space between the radiation members 7 of the sixth embodiment.

The description provided above is intended to provide mere examples without any limitations. Accordingly, it will be obvious to those skilled in the art that changes can be made to the embodiments of the present disclosure without departing from the scope of the accompanying claims.

The terms used in the present description and in the entire scope of the accompanying claims should be construed as terms "without limitations". For example, a term "including" or "included" should be construed as "not limited to that described to include". A term "have" should be construed as "not limited to that described to be held". Moreover, a modifier "a/an" described in the present description and in the accompanying claims should be construed to mean "at least one" or "one or more".

What is claimed is:

1. A target storage device comprising:

a target receiving member;

a tank configured to store a target received by the target receiving member, the target having been output as a droplet, the target generating extreme ultraviolet light when being irradiated with laser light;

a heater connected with the tank, the heater being configured to heat the tank; and a radiation member disposed to cover at least a part of the tank connected with the heater, the radiation member being configured to reflect heat radiation from the tank and the heater toward the tank, the target receiving member including an inclined portion that is disposed at a position crossing a trajectory of the target output into the chamber, and allows the target not irradiated with the laser light to collide with it and receives the target, and the tank storing the target received with the inclined portion.

2. A target storage device comprising:

a target receiving member;

a tank configured to store a target received by the target receiving member, the target having been output as a droplet, the target generating extreme ultraviolet light when being irradiated with laser light;

a heater connected with the tank, the heater being configured to heat the tank; and a radiation member disposed to cover at least a part of the tank connected with the heater, the radiation member being configured to reflect heat radiation from the tank and the heater toward the tank, the target receiving member including a receiver disposed at a position crossing a trajectory of the target output into the chamber, the receiver being configured to allow the target not irradiated with the laser light to collide with the receiver, and receive the target, and the tank storing the target received with the receiver.

3. The target storage device according to claim 1, wherein the inclined portion is disposed to be inclined with respect to a trajectory of the target.

4. The target storage device according to claim 1, wherein the inclined portion is made with use of a material, a contact angle of which with the molten target is 90° or larger but 180° or smaller.

5. The target storage device according to claim 1, wherein the target is made with use of at least one metallic material among tin, terbium, and gadolinium, and the tank stores the target in a molten state.

6. The target storage device according to claim 1, further comprising a casing configured to accommodate the tank connected with the heater, and the radiation member.

7. The target storage device according to claim 6, wherein the radiation member is formed on an inner surface of the casing.

8. The target storage device according to claim 1, wherein the radiation member includes a plurality of radiation members disposed with a space between each other, and the target storage device further comprises a heat insulating member disposed in the space between the radiation members.

9. The target storage device according to claim 1, the target storage device being connected with a chamber in which the extreme ultraviolet light is generated, and being capable of storing the target output into the chamber and not irradiated with the laser light, the target storage device further comprising a collection unit connected with the tank, the collection unit being configured to collect the target not irradiated with the laser light and guide the target to the tank.

10. The target storage device according to claim 9, wherein the collection unit is made with use of a material, a contact angle of which with the molten target is 90° or larger but 180° or smaller.

11. The target storage device according to claim 2, wherein the inclined portion is disposed to be inclined with respect to a trajectory of the target.

12. The target storage device according to claim 2, wherein the inclined portion is made with use of a material, a contact angle of which with the molten target is 90° or larger but 180° or smaller.

13. The target storage device according to claim 2, wherein the receiver is made with use of a material having heat resistance to a temperature equal to or higher than a melting point of the target.

14. The target storage device according to claim 2, wherein the target is made with use of at least one metallic material among tin, terbium, and gadolinium, and the tank stores the target in a molten state.

15. The target storage device according to claim 2, wherein the receiver is disposed inside the tank.

16. The target storage device according to claim 2, further comprising a casing configured to accommodate the tank connected with the heater, and the radiation member.

17. The target storage device according to claim 16, wherein the radiation member is formed on an inner surface of the casing.

18. The target storage device according to claim 2, wherein the radiation member includes a plurality of radiation members disposed with a space between each other, and the target storage device further comprises a heat insulating member disposed in the space between the radiation members.

19. The target storage device according to claim 2, the target storage device being connected with a chamber in which the extreme ultraviolet light is generated, and being capable of storing the target output into the chamber and not irradiated with the laser light, the target storage device further comprising a collection unit connected with the tank, the collection unit being configured to collect the target not irradiated with the laser light and guide the target to the tank.

20. The target storage device according to claim 19, wherein the collection unit is made with use of a material, a contact angle of which with the molten target is 90° or larger but 180° or smaller.

* * * * *